US008105743B2

(12) United States Patent
Ishii et al.

(10) Patent No.: US 8,105,743 B2
(45) Date of Patent: Jan. 31, 2012

(54) FINE ORGANIC SILICONE PARTICLE FOR LATENT ELECTROSTATIC IMAGE DEVELOPING TONERS, EXTERNAL ADDITIVE FOR TONERS, TONER FOR DEVELOPING LATENT ELECTROSTATIC IMAGE, AND TWO-COMPONENT DEVELOPER

(75) Inventors: Masayuki Ishii, Numazu (JP); Ryota Inoue, Mishima (JP); Yoshihiro Moriya, Numazu (JP); Shingo Sakashita, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 907 days.

(21) Appl. No.: 12/046,728

(22) Filed: Mar. 12, 2008

(65) Prior Publication Data

US 2008/0226998 A1 Sep. 18, 2008

(30) Foreign Application Priority Data

Mar. 15, 2007 (JP) ..... 2007-067182

(51) Int. Cl.
*G03G 13/08* (2006.01)

(52) U.S. Cl. ..... 430/123.51; 430/48; 430/108.1; 430/108.3

(58) Field of Classification Search ..... 430/48, 430/108.1, 108.3, 123.51; 399/262
See application file for complete search history.

(56) References Cited

U.S. PATENT DOCUMENTS

| | | | | |
|---|---|---|---|---|
| 6,054,239 | A * | 4/2000 | Ohira et al. | 430/108.3 |
| 7,318,989 | B2 | 1/2008 | Kotsugai et al. | |
| 2001/0031849 | A1 * | 10/2001 | Harada et al. | 528/39 |
| 2005/0118218 | A1 * | 6/2005 | Cassin | 424/401 |
| 2007/0037085 | A1 | 2/2007 | Ishii et al. | |
| 2007/0141500 | A1 | 6/2007 | Sugimoto et al. | |
| 2007/0218387 | A1 | 9/2007 | Ishii et al. | |
| 2008/0124549 | A1 * | 5/2008 | Lee et al. | 428/402 |

FOREIGN PATENT DOCUMENTS

| | | |
|---|---|---|
| JP | 6-266152 | 9/1994 |
| JP | 7-28276 | 1/1995 |
| JP | 9-319134 | 12/1997 |
| JP | 10-312089 | 11/1998 |
| JP | 2007-156099 | 6/2007 |
| JP | 2007-248911 | 9/2007 |
| JP | 2007-279702 | 10/2007 |

* cited by examiner

*Primary Examiner* — Thorl Chea
(74) *Attorney, Agent, or Firm* — Oblon, Spivak, McClelland, Maier & Neustadt, L.L.P.

(57) ABSTRACT

The present invention provides an organic silicone fine particle for latent electrostatic image developing toners, wherein the organic silicone fine particle has a volume average particle diameter of 0.05 μm to 6.0 μm which is obtained by measurement based on Coulter principle, and has a hemispherical polysiloxane cross-linked structure.

By mixing an appropriate amount of an organic silicone resin particle formed in a deformed shape (a hemispherical shape) in a toner or developer, the present invention prevents movement of the organic silicone resin particle from surface functional sites, the movement caused by a phenomenon such as detachment thereof from a toner surface or rolling movement on the toner surface, by the effect of its shape, and makes it possible to effectively achieve the expected function.

12 Claims, 4 Drawing Sheets

FINE ORGANIC SILICONE PARTICLE FOR LATENT ELECTROSTATIC IMAGE DEVELOPING TONERS, EXTERNAL ADDITIVE FOR TONERS, TONER FOR DEVELOPING LATENT ELECTROSTATIC IMAGE, AND TWO-COMPONENT DEVELOPER

BACKGROUND OF THE INVENTION

1. Field of the Invention

The present invention relates to a fine organic silicone particle for latent electrostatic image developing toners, an external additive for toners, a latent electrostatic image developing toner, a two-component developer, and a developing device using them.

2. Description of the Related Art

It has been proposed that the use of fine inorganic particles with large diameters is effective in improving toner's developability, transferability and cleanability, as well as in preventing embedment of external additive in toner particles that is caused by various stresses on the toner particles. Also disclosed is a technology in which organic fine particles that are 50 nm to 200 nm in diameter are added to toner in order to provide an effective spacer function. When an external additive is mixed with toner using a mixer, it is necessary to dissociate aggregates of the external additive and toner for deposition of the external additive onto the toner surface. However, this process causes a situation where some particles of external additive occasionally remains free without adhering to the toner surface, or where some particles of external additive bonded to the toner surface to some degree are detached from the toner surface by stress, a friction, etc. in the developing device. The above free external additive is often recognized to move to the photoconductor with toner at the time of toner development on a photoconductor surface, remaining on the photoconductor surface even after transfer of the developed image and adhering to the photoconductor surface without be removed by cleaning process. When free external additive particles are deposited onto the photoconductor surface, they become a frequent cause of image quality defect on a copy (filming, etc.) or scratches on the photoconductor, thereby reducing the lifetime of the photoconductor. Further this also causes contamination of the copier when the free external additive drops out of the developing device upon development. Moreover, the free external additive adheres to carrier surface in a developer and inhibits transportation of electric charges between toner and carrier, which may result in reduced toner charge amount.

Japanese Patent Application Laid-Open (JP-A) No. 06-266152 discloses using as external additives fine inorganic particles having a volume-average particle diameter of 30 nm to 150 nm and organic fine particles having a volume-average particle diameter of 50 nm to 200 nm made of high-melting point resin with a flow-starting temperature of 200° C. or more in order to reduce the degree of embedment of external additive into toner particles. However, it is technically difficult to effect uniform surface treatment on such two different types of fine particles, and it is also difficult to strike a balance between prevention of embedment and prevention of detachment of external additive because the two external additives have different affinities for the toner binder. Meanwhile, JP-A No. 07-28276 discloses using as external additives small diameter-inorganic particles in combination with large diameter-inorganic particles, such as particles of silica, titanic oxide or alumina that are hydrophobized by treatment with a silane coupling agent. However, sufficient external additive functions have not yet been achieved by this technology, which is due in part to the fact that external additive particles generally offer a broad particle size distribution. JP-A No. 09-319134 discloses adding, among inorganic external additives with a relatively large particle diameter and organic external additives with a relatively small particle diameter, organic and inorganic external additives each having a number-average particle diameter of 0.05 μm to 0.5 μm in such amounts that the toner turbidity is 10 to 50. However, this technique is not directly associated with prevention of embedment of external additive in toner particles and with prevention of detachment of the external additive from the toner particles. Furthermore, JP-A No. 10-312089 discloses, in order to increase the toner charge amount, using as an external additive silica that is hydrophobized by treatment with a silicone oil and that has a primary particle average diameter of 30 nm to 100 nm in combination with a zinc salt of benzylic acid derivative as a charge controlling agent. This technique is not also directly associated with prevention of embedment of external additive in toner particles and prevention of detachment of the external additive from the toner particles.

BRIEF SUMMARY OF THE INVENTION

To solve the above-described problems pertinent in the art, by mixing an appropriate amount of deformed (hemispherical shape) organic silicone resin particles in a toner or developer, the present invention prevents, by means of their shape effect, the organic silicone resin particles from detaching from toner surface or from moving away from the surface function site due to rolling movement on the toner surface, thereby allowing the organic resin particles to effectively offer their expected functions. Conventional deformed shapes directed to achieve this effect have been randomly-deformed, non-spherical shapes such as those obtained by pulverization; thus, it has been difficult to establish a reasonable trade-off between flowability and expected function, both of which are associated with their complex shape. In addition, deformation by means of pulverization has been insufficient in terms of shape designing.

The above problems are solved by the present invention as follows.

(1) An organic fine particle for latent electrostatic image developing toners, wherein the organic fine particle has a volume average particle diameter of 0.05 μm to 6.0 μm which is obtained by measurement based on Coulter principle, and has a hemispherical shape.

(2) An organic silicone fine particle for latent electrostatic image developing toners, wherein the organic silicone fine particle has a volume average particle diameter of 0.05 μm to 6.0 μm which is obtained by measurement based on Coulter principle, and has a hemispherical polysiloxane cross-linked structure.

(3) The organic silicone fine particle according to the item (2), wherein the polysiloxane cross-linked structure constituting the organic silicone fine particle is composed of two or more siloxane units selected from siloxane units each expressed by the following Formula 1, and has an average siloxane unit expressed by the following Formula 2, $$R1mSiO(4-m)/2 \qquad \text{Formula 1}$$

$$R2nSiO(4-n)/2 \qquad \text{Formula 2}$$

where R1 and R2 are respectively an organic group having a carbon atom directly bound to an Si atom, "m" is an integer of 0 to 3, "n" is from 0.40 to 0.77.

(4) The organic silicone fine particle according to the item (3), wherein the polysiloxane cross-linked structure contains a first siloxane unit in the case where "m" in the Formula 1 is 0 and a second siloxane unit in the case where "m" in the Formula 1 is 1, and a molar ratio of [the first siloxane unit]/[the second siloxane unit] is 23/77 to 40/60.

(5) The organic silicone fine particle according to the item (3), wherein R1 in the Formula 1 and R2 in the Formula 2 are respectively a methyl group.

(6) An external additive for the latent electrostatic image developing toners, containing a colored particle, and an external additive, wherein the colored particle contains at least a binder resin, a colorant, and a releasing agent, the external additive is an organic silicone fine particle having a volume average particle diameter of 0.05 μm to 6.0 μm which is obtained by measurement based on Coulter principle and has a hemispheric polysiloxane cross-linked structure.

(7) A toner for developing latent electrostatic images, containing a colored particle, and an external additive, wherein the colored particle contains at least a binder resin, a colorant, and a releasing agent, the external additive is an organic silicone fine particle having a volume average particle diameter of 0.05 μm to 6.0 μm which is obtained by measurement based on Coulter principle and has a hemispheric polysiloxane cross-linked structure.

(8) The toner for developing latent electrostatic images according to the item (7), further containing one or more other external additives.

(9) The toner for developing latent electrostatic images according to the item (8), wherein the one or more other external additives contain at least one external additive having a B.E.T. specific surface area in the range of 20 $m^2/g$ to 300 $m^2/g$.

(10) The toner for developing latent electrostatic images according to the item (8), wherein the one or more other external additives are selected from the group consisting of silica, titanium compounds, alumina, cerium oxides, calcium carbonates, magnesium carbonates, calcium phosphates, fluorine-containing resin fine particles, silica-containing resin fine particles, and nitrogen-containing resin fine particles.

(11) The toner for developing latent electrostatic images according to the item (10), wherein the titanium compound is obtained by reacting a part of or all of $TiO(OH)_2$ produced by a wet system with any one of a silane compound and a silicone oil.

(12) The toner for developing latent electrostatic images according to the item (10), wherein the titanium compound has a specific gravity of 2.8 to 3.6.

(13) The toner for developing latent electrostatic images according to the item (7), wherein the colored particle is obtained by dissolving or dispersing in an organic solvent a toner composition containing a toner binder resin composed of a compound having an active hydrogen group and a modified polyester resin capable of reacting with an active hydrogen group, then dispersing into droplets the resulting solution or dispersion in an aqueous medium containing a resin fine particle, reacting the compound having an active hydrogen group with the modified polyester resin capable of reacting with an active hydrogen group, and finally removing the solvent from the dispersion fluid thus obtained.

(14) The toner for developing latent electrostatic images according to the item (7), wherein the colored particle is obtained by a melt-kneading/pulverization method.

(15) A developer for developing latent electrostatic images, containing a toner for developing latent electrostatic images, and a carrier, wherein the toner is a toner for developing latent electrostatic images, which contains a colored particle and an external additive, the colored particle contains at least a binder resin, a colorant, and a releasing agent, the external additive is an organic silicone fine particle having a volume average particle diameter of 0.05 μm to 6.0 μm which is obtained by measurement based on Coulter principle and has a hemispheric polysiloxane cross-linked structure.

(16) An image forming method, including developing a latent electrostatic image formed on a latent image bearing member using a toner to form a toner image, and transferring the toner image onto a transfer material to form a transferred image, wherein the toner is a toner for developing latent electrostatic images, which contains a colored particle and an external additive, the colored particle contains at least a binder resin, a colorant, and a releasing agent, the external additive is an organic silicone fine particle having a volume average particle diameter of 0.05 μm to 6.0 μm which is obtained by measurement based on Coulter principle and has a hemispheric polysiloxane cross-linked structure.

(17) An image forming method, including developing a latent electrostatic image formed on a latent image bearing member using a developer to form a toner image, and transferring the toner image onto a transfer material to form a transferred image, wherein the developer used in the developing contains a toner and a carrier; the toner is a toner for developing latent electrostatic images, which contains a colored particle and an external additive; the colored particle contains at least a binder resin, a colorant, and a releasing agent; the external additive is an organic silicone fine particle having a volume average particle diameter of 0.05 μm to 6.0 μm which is obtained by measurement based on Coulter principle and has a hemispheric polysiloxane cross-linked structure.

(18) A process cartridge detachably mounted to a main body of an image forming apparatus, having a photoconductor, and a developing unit, the photoconductor and the developing unit being integrated as a unit, the process cartridge may further having one image processing unit selected from a charging unit, a transfer unit, a cleaning unit, and a charge eliminating unit, wherein the developing unit holds a toner; the toner is a toner for developing latent electrostatic images, which contains a colored particle and an external additive; the colored particle contains at least a binder resin, a colorant, and a releasing agent; the external additive is an organic silicone fine particle having a volume average particle diameter of 0.05 μm to 6.0 μm which is obtained by measurement based on Coulter principle and has a hemispheric polysiloxane cross-linked structure.

A hemispheric organic silicone resin particle according to the present invention tends to adhere to a toner with its flat surface directed to the bonding surface and with its spherical surface directed outward because of its shape and structure, therefore occurrence of rolling movement on a toner surface due to an environmental stress is less frequent in this hemispheric organic silicone resin particle than in a conventional spherical resin particle, and by directing the spherical surface outward it became possible for the hemispheric organic silicone resin particle to provide a toner flowability equal or more to that provided by a spherical resin particle.

When some particles of the hemispheric organic silicone resin particle adhere to a toner with their spherical surfaces directed to the toner surface in an early period of addition, the direction of the particles to a toner surface is easily changed to a more stable direction with their flat surfaces directed to the toner surface due to an environmental stress, which achieves high adhesion of the hemispheric organic silicone resin particle to a toner surface that could not be achieved by a conventional resin particle and solves, at the same time, a problem of fixing inhibition caused by adding an inorganic external additive such as silica to a toner. In addition, it is possible to use the organic silicone resin particle as an additive into a toner particle in a toner manufacturing process.

DETAILED DESCRIPTION OF THE INVENTION

[Binder Resin]

Figure 1:
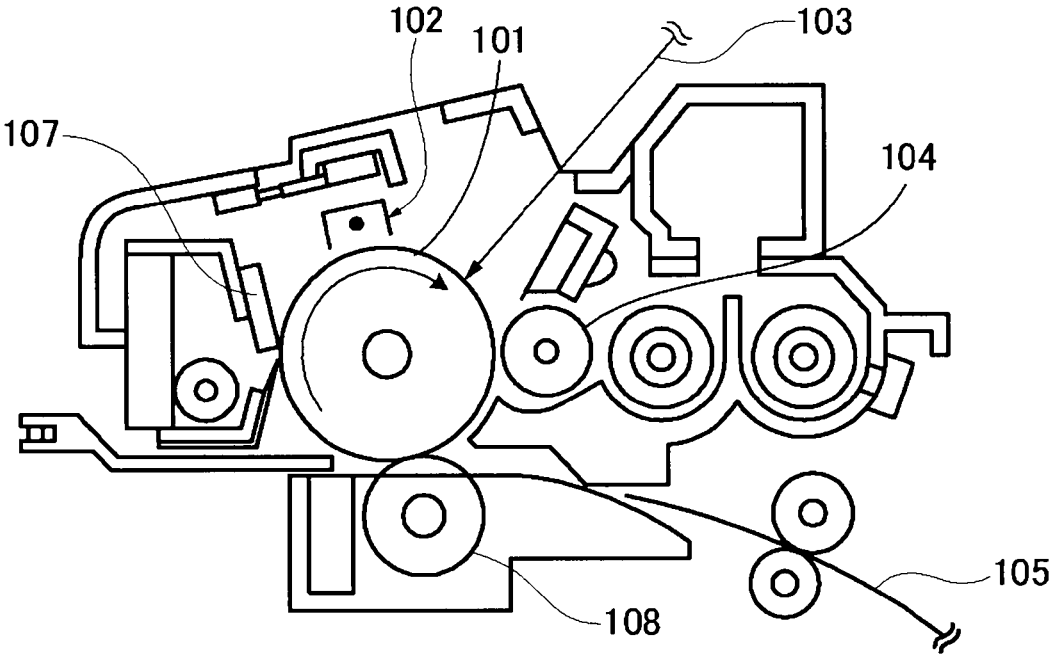
FIG. 1 illustrates an example of a process cartridge of the present invention.

The binder resin contained in the colored particles according to the present invention is not particularly limited, can be appropriately selected from those known publicly, and includes, for example, homopolymers and copolymers of styrenes such as styrene and chlorostyrene; monoolefins such as ethylene, propylene, butylene, and isoprene; vinyl esters such as vinyl acetate, vinyl propionate, vinyl benzoate, and vinyl butyrate; α-methylene aliphatic monocarboxylate esters such as methyl acrylate, ethyl acrylate, butyl acrylate, dodecyl acrylate, octyl acrylate, phenyl acrylate, methyl methacrylate, ethyl methacrylate, butyl methacrylate, and dodecyl methacrylate; vinyl ethers such as vinyl methyl ether, vinyl ethyl ether, and vinyl butyl ether; and vinyl ketones such as vinyl methyl ketone, vinyl hexyl ketone, and vinyl isopropenyl ketone.

The particularly representative binder resins include, for example, polystyrene resins, polyester resins, styrene-acrylic acid alkyl copolymers, styrene-methacrylic acid alkyl copolymers, styrene-acrylonitrile copolymers, styrene-butadiene copolymers, styrene-maleic acid anhydrate copolymers, polyethylene resins, and polypropylene resins. These may be used alone or in combination of two or more.

Among them, polyester resins are preferable, and urea-modified polyester resins are more preferable, and the combination of the urea-modified polyester resin and an unmodified polyester resin is the most preferable.

[Colorant]

The colorant is not particularly limited and can be appropriately selected from publicly known dyes and pigments depending on the purpose. For example, carbon black, nigrosine dyes, iron black, naphthol yellow S, hanza yellow (10G, 5G, G), cadmium yellow, yellow iron oxide, yellow ocher, chrome yellow, titanium yellow, polyazo yellow, oil yellow, hanza yellow (GR, A, RN, R), pigment yellow L, benzidine yellow (G, GR), permanent yellow (NCG), Balkan fast yellow (5G, R), tartrazine lake, quinoline yellow lake, anthrazane yellow BGL, isoindolinone yellow, colcothar, red lead, lead vermillion, cadmium red, cadmium mercury red, antimony vermillion, permanent red 4R, parared, faicer red, parachloroorthonitroaniline red, lithol fast scarlet G, brilliant fast scarlet, brilliant carmine BS, permanent red (F2R, F4R, FRL, FRLL, is F4RH), fast scarlet VD, Balkan fast rubine B, brilliant scarlet G, lithol rubine GX, permanent red F5R, brilliant carmine 6B, pigment scarlet 3B, Bordeaux 5B, toluidine maroon, permanent Bordeaux F2K, helio Bordeaux BL, Bordeaux 10B, bon maroon light, bon maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, Victoria blue lake, non-metallic phthalocyanine blue, phthalocyanine blue, fast sky blue, indanthrene blue (RS, BC), indigo, ultramarine blue, Prussian blue, anthraquinone blue, fast violet B, methyl violet lake, cobalt violet, manganese violet, dioxane violet, anthraquinone violet, chrome green, zinc green, chromium oxide, pyridian, emerald green, pigment green B, naphthol green B, green gold, acid green lake, malachite green lake, phthalocyanine green, anthraquinone green, titanium oxide, zinc flower, and lithopone are included. These may be used alone or in combination of two or more.

The amount of the colorant in the colored particle (the toner base) is not particularly limited, can be appropriately selected depending on the purpose, and is preferably 1% by mass to 15% by mass and more preferably 3% by mass to 10% by mass.

When the amount is less than 1% by mass, a coloring force of the toner is reduced. When it exceeds 15% by mass, dispersion defect of pigments in the toner occurs, sometimes resulting in reducing the coloring force and reducing an electric property of the toner.

[Master Batch]

The colorant may be used as a master batch formulated with the resin. The resin is not particularly limited, can be appropriately selected from those known publicly depending on the purpose, and includes, for example, polymers of styrene or substituents thereof, styrene based copolymers, polymethyl methacrylate, polybutyl methacrylate, polyvinyl chloride, polyvinyl acetate, polyethylene, polypropylene, polyester, epoxy resins, epoxy polyol resins, polyurethane, polyamide, polyvinyl butyral, polyacrylic acid resins, rosin, modified rosin, terpene resins, aliphatic hydrocarbon resins, alicyclic hydrocarbon resins, aromatic petroleum resins, chlorinated paraffin, and paraffin wax. These may be used alone or in combination of two or more.

The polymers of styrene or the substituents thereof include, for example, polyester resins, polystyrene, poly-p-chlorostyrene, and polyvinyl toluene. The styrene based copolymers include, for example, styrene-p-chlorostyrene copolymers, styrene-propylene copolymers, styrene-vinyl toluene copolymers, styrene-vinyl naphthalin copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloro-methacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene maleic acid copolymers, and styrene-maleate ester copolymers.

The master batch can be produced by mixing or kneading the resin for the master batch and the colorant with a high shearing force. At that time, in order to enhance an interaction between the colorant ant the resin, it is preferable to add an organic solvent. A wet cake of the colorant can also be used directly in a so-called flushing method, and this is suitable in terms of no need of drying. This flushing method is the method in which an aqueous paste of the colorant containing the water is mixed or kneaded together with the resin and the organic solvent, and the colorant is allowed to migrate to a resin side followed by removing water and the organic solvent component. A high shearing dispersing apparatus such as three roll mill is suitably used for the above mixing or kneading.

[Releasing Agent]

The releasing agent in the present invention is not particularly limited, can be appropriately selected from those known publicly depending on the purpose, and suitably includes, for example, waxes.

The waxes include, for example, carbonyl group-containing waxes, polyolefin waxes, and long chain hydrocarbons. These may be used alone or in combination of two or more. Among them, carbonyl group-containing waxes are preferable.

The carbonyl group containing waxes include, for example, polyalkane ester, polyalkanol ester, polyalkane amide, polyalkyl amide, and dialkyl ketone. The polyalkane ester includes, for example, carnauba wax, montan wax, trimethylolpropane tribehenate, pentaerythritol tetrabehenate, pentaerythritol diacetate dibehenate, glycerine tribehenate, and 1,18-octadecanediol distearate. The polyalkanol ester includes, for example, tristearyl trimellitate and distearyl maleate. The polyalkane amide includes, for example, dibehenyl amide. The polyalkyl amide includes, for example, tristearyl trimellitate amide. The dialkyl ketone includes, for example, distearyl ketone. Among them carbonyl group-containing waxes, polyalkane ester is preferable.

Polyolefin waxes include, for example, polyethylene wax and polypropylene wax.

Long chain hydrocarbons include, for example, paraffin wax and Sasol wax.

A melting point of the releasing agent is not particularly limited, can be appropriately selected depending on the purpose, and is preferably 40° C. to 160° C., more preferably 50° C. to 120° C. and particularly preferably 60° C. to 90° C. When the melting point is less than 40° C., the wax sometimes harmfully affects the heat resistant storage stability. When it exceeds 160° C., cold offset sometimes occurs easily when fixed at low temperatures.

The melt viscosity of the releasing agent is preferably 5 cps to 1,000 cps and more preferably 10 cps to 100 cps as a measured value at temperature which is 20° C. higher than the melting point of the wax. When the melt viscosity is less than 5 cps, the releasing property is sometimes degraded. When it exceeds 1,000 cps, no enhancement effect on hot offset resistance and fixing property at low temperature is not sometimes obtained.

The amount of the releasing agent in the colored particle (the toner base) is not particularly limited, can be appropriately selected depending on the purpose, and is preferably 0% by mass to 40% by mass and more preferably 3% by mass to 30% by mass. When the amount exceeds 40% by mass, the fluidity of the toner is sometimes degraded.

[Other Components]

In the present invention, other components may be contained in the colored particle (the toner base particle). The other components are not particularly limited, can be appropriately selected depending on the purpose, and include, for example, charge controlling agents, fine inorganic particles, fluidity enhancers, cleaning ability enhancers, magnetic materials, metal soaps, and the organic silicone fine particle according to the present invention.

The charge controlling agent is not particularly limited, can be appropriately selected from those known publicly depending on the purpose, and includes, for example, nigrosine based dyes, triphenylmethane based dyes, chromium containing metal complex dyes, molybdic acid chelate pigments, rhodamine based dyes, alkoxy based amine, quaternary ammonium salts (including fluorine modified quaternary ammonium salts), alkyl amide, a simple substance of phosphorus or compounds thereof, a simple substance of tungsten or compounds thereof, fluorine based active agents, metal salts of salicylic acid and metal salts of salicylate derivatives. These may be used alone or in combination of two or more.

As the charge controlling agent, commercially available products may be used. The commercially available products include, for example, BONTRON 03 of the nigrosine dye, BONTRON P-51 of the quaternary ammonium salt, BONTRON S-34 of the metal-containing azo dye, E-82 of oxynaphthoic acid-based metal complex, E-84 of salicylic acid-based metal complexes, E-89 of phenol-based condensate (manufactured by Orient Chemical Industries Ltd.); TP-302 and TP-415 of a quaternary ammonium salt molybdenum complexes (manufactured by Hodogaya Chemical Co., Ltd.); Copy Charge PSY VP2038 of the quaternary ammonium salts, Copy Blue PR of the triphenylmethane derivative, Copy Charge NEG VP2036 and Copy Charge NX VP434 of the quaternary ammonium salts (manufactured by Hoechst); LRA-901, LR-147 which is a boron complex (manufactured by Japan Carlit Co., Ltd.) copper phthalocyanine, perylene, quinacridone, azo-based pigments, and polymer-based compounds having functional groups such as sulfonic acid group, carboxyl group and quaternary ammonium salt are included.

The amount of the charge controlling agent in the colored particle (the toner base particle) varies depending on the type of the resin, the presence or absence of the additive, and the dispersion method, can not be primarily defined, but is preferably 0.1 parts by mass to 10 parts by mass and more preferably 0.2 parts by mass to 5 parts by mass relative to 100 parts by mass of the binder resin. When the amount is less than 0.1 parts by mass, the charge controlling property is not sometimes obtained. When it exceeds 10 parts by mass, the charge property of the toner becomes too large, the effect of the major charge controlling agent is reduced, and an electrostatic sucking force with the developing roller is increased, resulting in the reduction of fluidity of the developer and the reduction of the image density.

[Colored Particle (Toner Base Particle)]

The toner of the present invention is composed of a colored particle (a toner base particle) containing at least toner material including at least a binder resin, a colorant and a releasing agent, and at least the external additive of the present invention, and may contain preferably other external additives, and further the other components if necessary.

The colored particle (the toner base particle) of the present invention can be produced by pulverization method or polymerization method such as suspension polymerization method, emulsification polymerization method or melting suspension.

The pulverization method is such a method as obtaining base particles of the toner by melting or kneading the toner materials, and pulverizing and classifying them. In the case of the pulverization method, for the purpose of enhancing an average circularity of the toner, a mechanical impact force may be given to the obtained toner base particles to control the shape. In this case, the mechanical impact force can be imparted to the toner base particles using an apparatus such as hybridizer and mechanofusion.

The above toner materials are mixed and the mixture is placed in a melting/kneading machine to melt and knead it. As the melting/kneading machine, uniaxial continuous kneaders, biaxial continuous kneaders, and batch system kneaders by roll mill can be used. For example, KTK type biaxial extruder manufactured by Kobe Steel, Ltd., TEM type extruder manufactured by Toshiba Machine Co., Ltd., the biaxial extruder manufactured by KCK, PCM type biaxial extruder manufactured by Ikegai Tekkosho and the koneader manufactured by Bus are suitably used. It is preferable to perform this melting/kneading under a proper condition not to result in cleavage of a molecular chain of the binder resin. Specifically, the melting/kneading temperature is determined with reference to the softening point of the binder resin. When the temperature is much higher than the softening point, the cleavage is remarkable whereas when it is much lower than the softening point, the dispersion does not proceed sometimes.

In the pulverization, the kneaded product obtained in the kneading is pulverized. In this pulverization, it is preferable to first pulverize roughly and subsequently pulverize finely the kneaded product. At that time, the method of pulverizing by crushing to a crush plate in jet stream, the method of pulverizing by crushing particles one another in jet stream and the method of pulverizing in a narrow gap between a mechanically rotating rotor and stator are preferably used.

In the classification, a pulverized product obtained in the above pulverization is classified to adjust to particles having the given particle diameter. For example, the classification can be performed by removing a fine particle fraction by cyclone, decanter or centrifugation.

After completion of the pulverization and classification, the pulverized product is classified in gas flow with a centrifugal force to produce the toner base particle having the given particle diameters.

[Production of Colored Particle (Toner Base Particle) by Polymerization Method]

In the polymerization method, the toner base particle can be obtained by emulsifying or dispersing a solution or a dispersion of the toner materials in a aqueous medium to prepare an emulsion or dispersion and subsequently granulating.

A preferable aspect of the toner of the present invention includes the toner base particle obtained by emulsifying or dispersing a solution or a dispersion of the toner materials containing at least an active hydrogen group-containing compound and a modified polyester resin (hereinafter also referred to as the "prepolymer") capable of reacting with the active hydrogen group-containing compound in the aqueous medium, and reacting the active hydrogen group-containing compound with a modified polyester resin (prepolymer) capable of reacting with the active hydrogen group-containing compound to generate particles containing at least an adhesive base.

[Solution or Dispersion of Toner Materials]

Hereinafter, the toner base particle in preferable aspects of the present invention will be described.

The solution or the dispersion of the toner materials is obtained by dissolving or dispersing the toner materials in a solvent. The toner materials are not particularly limited as long as they can form the toner, can be appropriately selected depending on the purpose, and for example, include at least either the active hydrogen group-containing compound and the modified polyester resin (prepolymer) capable of reacting the active hydrogen group-containing compound, include the fixing aid, the colorant, and the wax, and further if necessary include the other components described above such as unmodified polyester resins, and releasing agents and charge controlling agents.

It is preferable that the solution or the dispersion of the toner materials is prepared by dissolving or dispersing the toner materials in an organic solvent. It is preferable to remove the organic solvent upon granulation or after the granulation of the toner.

[Organic Solvent]

The organic solvent is not particularly limited as long as it is the solvent capable of dissolving or dispersing the toner materials, can be appropriately selected depending on the purpose, and for example, one which has a boiling point of lower than 150° C. and is volatile is preferable in terms of easiness of its removal. For example, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methylethylketone and methyl isobutyl ketone are included. It is preferable to be an ester based solvent, and ethyl acetate is particularly preferable. These may be used alone or in combination of two or more.

The amount of the organic solvent to be used is not particularly limited, can be appropriately selected depending on the purpose, and is, for example, preferably 40 parts by mass to 300 parts by mass, more preferably 60 parts by mass to 140 parts by mass and still more preferably 80 parts by mass to 120 parts by mass relative to 100 parts by mass of the toner materials.

In the method of producing the toner base particle in the preferable aspects of the present invention, the solution or the dispersion of the toner materials can be prepared by dissolving or dispersing the toner materials e.g., the active hydrogen group-containing compound, the prepolymer capable of reacting with the active hydrogen group-containing compound, the fixing aid, the unmodified polyester resin, the wax, the colorant, the charge controlling agent, and the like in the organic solvent. In the toner materials, the components other than the modified polyester resin (prepolymer) capable of reacting with the active hydrogen group-containing compound may be added and mixed in the aqueous medium in the preparation of the aqueous medium described later, or may be added together with the solution or the dispersion in the aqueous medium when the solution or the dispersion of the toner materials is added to the aqueous medium.

[Active Hydrogen Group-Containing Compound]

The active hydrogen group-containing compound acts as an extending agent or a crosslinking agent when the prepolymer capable of reacting the active hydrogen group-containing compound performs an extending reaction or a crosslinking reaction in the aqueous medium.

The active hydrogen group-containing compound is not particularly limited as long as it has the active hydrogen, and can be appropriately selected depending on the purpose. For example, when the prepolymer capable of reacting with the active hydrogen group-containing compound is a polyester prepolymer (A) having the isocyanate group, amines (B) is preferable because of being capable of making it have a high molecular weight by the extending reaction or the crosslinking reaction with the polyester prepolymer (A) containing the isocyanate group.

The active hydrogen group is not particularly limited, can be appropriately selected depending on the purpose, and includes hydroxyl groups (alcoholic hydroxyl groups and phenolic hydroxyl groups), amino groups, carboxyl groups and mercapto groups. These may be used alone or in combination of two or more. Among them, the alcoholic hydroxyl groups are preferable.

The amines (B) are not particularly limited, can be appropriately selected depending on the purpose, and include diamine (B1), trivalent or more polyamine (B2), amino alcohol (B3), aminomercaptan (B4) amino acids (B5) and those (B6) obtained by blocking amino group in the B1 to B5.

These may be used alone or in combination of two or more. Among them, diamine (B1) or a mixture of diamine (B1) and trivalent or more polyamine (B2) in a small amount is particularly preferable.

Diamine (B1) includes aromatic diamine, alicyclic diamine, aliphatic diamine. Aromatic diamine includes phenylenediamine, diethyltoluenediamine and 4,4'-diaminodiphenylmethane. Alicyclic diamine includes 4,4'-diamino-3,3'-dimethyldicyclohexylmethane, diaminocyclohexane and isophoronediamine. Aliphatic diamine includes ethylenediamine, tetramethylenediamine and hexamethylenediamine.

Trivalent or more polyamine (B2) includes diethylenetriamine and triethylenetetraamine.

Amino alcohol (B3) includes ethanolamine and hydroxyethylaniline.

Aminomercaptan (B4) includes aminoethylmercaptan and aminopropylmercaptan.

Amino acid (B5) includes aminopropionic acid and aminocaproic acid.

Those (B6) obtained by blocking the amino group in the (B1) to (B5) include ketimine compounds and oxazoline compounds obtained from amines in the (B1) to (B5) and ketones (acetone, methylethylketone, methyl isobutyl ketone).

To terminate the extending reaction or the crosslinking reaction of the active hydrogen group-containing compound with the polymer capable of reacting with the active hydrogen group-containing compound, a reaction terminator can be used. It is preferable to use the reaction terminator because the molecular weight of the adhesive base can be controlled in a desired range. The reaction terminator includes monoamine (diethylamine, dibutylamine, butylamine, laurylamine), or those (ketimine compounds) obtained by blocking them.

For the ratio of the polyester prepolymer (A) containing the isocyanate group to amines (B), a mixed equivalent ratio [NCO]/[NHx] of the isocyanate group [NCO] in the prepolymer (A) containing the isocyanate group to the amino group [NHx] in amines (B) is preferably 1/3 to 3/1, more preferably 1/2 to 2/1 and particularly preferably 1/1.5 to 1.5/1.

When the mixed equivalent ratio [NCO]/[NHx] is less than 1/3, the fixing property at low temperature is sometimes reduced. When it is larger than 3/1, the molecular weight of the urea-modified polyester resin becomes small, and the hot offset resistance is sometimes degraded.

[Modified Polyester Polymer (Prepolymer) Capable of Reacting With Active Hydrogen Group-Containing Compound]

The prepolymer capable of reacting with the active hydrogen group-containing compound is not particularly limited as long as it at least has a site capable of reacting with the active hydrogen group-containing compound. These may be used alone or in combination of two or more. Among them, the modified polyester resin is particularly preferable in terms of high fluidity upon melting and transparency.

The site capable of reacting with the active hydrogen group-containing compound in the prepolymer is not particularly limited, can be appropriately selected from publicly known substituent groups, and includes, for example, an isocyanate group, an epoxy group, a carboxylic group and an acid chloride group.

These may be included alone or in combination of two or more. Among them, the isocyanate group is particularly preferable.

Among the prepolymers, urea bond generating group-containing polyester resins (RMPE) are particularly preferable because the molecular weight of a high molecular component is easily controlled, an oilless fixing property at low temperature can be assured in a dry toner, and in particular, in the case of having no releasing oil application mechanism to a heating medium for fixing, the good releasing property and fixing property can be assured.

The urea bond generating group includes, for example the isocyanate group. When the urea bond generating group in the urea bond generating group-containing polyester resin (RMPE) is the isocyanate group, the polyester resin (RMPE) particularly suitably includes the isocyanate group-containing polyester prepolymer (A).

The isocyanate group-containing polyester prepolymer (A) is not particularly limited, can be appropriately selected depending on the purpose, and includes, for example, polycondensates of polyol (PO) and polycarboxylic acid (PC), with the active hydrogen group-containing polyester resin reacted with polyisocyanate (PIC).

The polyol (PO) is not particularly limited, can be appropriately selected depending on the purpose, and includes, for example, diol (DIO), trivalent or more polyol (TO) and mixtures of diol (DIO) and trivalent or more polyol (TO). These may be used alone or in combination of two or more. Among them, the diol (DIO) alone or the mixture of the diol (DIO) and the trivalent or more polyol (TO) in a small amount is preferable.

The diol (DIO) includes, for example, alkylene glycol, alkylene ether glycol, alicyclic diol, alkylene oxide adducts of alicyclic diol, bisphenols and alkylene oxide adducts of bisphenols.

The alkylene glycol has preferably 2 to 12 carbon atoms, and includes, for example, ethylene glycol, 1,2-propylene glycol, 1,3-propylene glycol, 1,4-butanediol and 1,6-hexanediol. The alkylene ether glycol includes, for example, diethylene glycol, triethylene glycol, dipropylene glycol, polyethylene glycol, polypropylene glycol and polytetramethylene ether glycol. The alicyclic diol includes, for example, 1,4-cyclohexane dimethanol and hydrogenated bisphenol A. The alkylene oxide adducts of the alicyclic diol include adducts to the alicyclic diol of alkylene oxide such as ethylene oxide, propylene oxide and butylene oxide. The bisphenols include, for example, bisphenol A, bisphenol F and bisphenol S. The alkylene oxide adducts of the bisphenols include, for example, those obtained by adding alkylene oxide such as ethylene oxide, propylene oxide and butylene oxide to the bisphenols.

Among them, alkylene glycol having 2 to 12 carbon atoms and alkylene oxide adducts of bisphenols are preferable. The alkylene oxide adducts of bisphenols, or the mixture of the alkylene oxide adducts of bisphenols and alkylene glycol having 2 to 12 carbon atoms is particularly preferable.

As the trivalent or more polyol (TO), trivalent to octavalent or more ones are preferable, and for example, trivalent or more polyvalent aliphatic alcohol, trivalent or more polyphenols, and alkylene oxide adducts of trivalent or more polyphenols are included.

The trivalent or more polyvalent aliphatic alcohol includes, for example, glycerine, trimethylolethane, trimethylolpropane, pentaerythritol, and sorbitol. The trivalent or more polyphenols include, for example, trisphenol PA, phenol novolak, and cresol novolak. The alkylene oxide adducts of trivalent or more polyphenols include, for example, those obtained by adding alkylene oxide such as ethylene oxide, propylene oxide, and butylene oxide to the trivalent or more polyphenols.

In the mixture of the diol (DIO) and the trivalent or more polyol (TO), a mixed mass ratio (DIO:TO) of the diol (DIO) to the trivalent or more polyol (TO) is preferably 100:0.001 to 10 and more preferably 100:0.01 to 1.

The polycarboxylic acid (PC) is not particularly limited, can be appropriately selected depending on the purpose, and includes, for example, dicarboxylic acid (DIC), trivalent or more polycarboxylic acid (TC), and mixtures of dicarboxylic acid (DIC) and trivalent or more polycarboxylic acid (TC).

These may be used alone or in combination of two or more. Among them, dicarboxylic acid (DIC) alone or the mixture of DIC and trivalent or more polycarboxylic acid (TC) in a small amount is preferable.

The dicarboxylic acid includes, for example, alkylene dicarboxylic acid, alkenylene dicarboxylic acid and aromatic dicarboxylic acid.

The alkylene dicarboxylic acid includes, for example, succinic acid, adipic acid and sebacic acid. The alkenylene dicarboxylic acid preferably has 4 to 20 carbon atoms and includes, for example, maleic acid and fumaric acid. The aromatic dicarboxylic acid preferably has 8 to 20 carbon atoms and includes, for example, phthalic acid, isophthalic acid, terephthalic acid and naphthalene dicarboxylic acid.

Among them, alkenylene dicarboxylic acid having 4 to 20 carbon atoms and aromatic dicarboxylic acid having 8 to 20 carbon atoms are preferable.

The trivalent or more polycarboxylic acid (TO) is preferably trivalent to octavalent or more ones, and includes, for example, aromatic polycarboxylic acids.

The aromatic polycarboxylic acids preferably have 9 to 20 carbon atoms, and include, for example, trimellitic acid and pyromellitic acid.

As the polycarboxylic acid (PC), it is possible to also use acid anhydrate or lower alkyl ester of any ones selected from the dicarboxylic acid (DIC), the trivalent or more polycarboxylic acid (TC), and the mixture of the dicarboxylic acid (DIC) and the trivalent or more polycarboxylic acid (TC). The lower alkyl ester includes, for example, methyl ester, ethyl ester, and isopropyl ester.

In the mixture of the dicarboxylic acid (DIC) and the trivalent or more polycarboxylic acid (TC), the mixed mass ratio (DIC:TC) of the dicarboxylic acid (DIC) to the trivalent or more polycarboxylic acid (TC) is not particularly limited, can be appropriately selected depending on the purpose, and for example, is preferably 100:0.01 to 10 and more preferably 100:0.01 to 1.

A mixed ratio when the polyol (PO) and the polycarboxylic acid (PC) are polycondensed is not particularly limited, can be appropriately selected depending on the purpose, and for example, an equivalent ratio ([OH]/[COOH]) of hydroxyl group [OH] in the polyol (PO) to carboxyl group [COOH] in the polycarboxylic acid (PC) is preferably 2/1 to 1/1 typically, more preferably 1.5/1 to 1/1 and particularly preferably 1.3/1 to 1.02/1.

The amount of the polyol (PO) in the isocyanate group-containing polyester prepolymer (A) is not particularly limited, can be appropriately selected depending on the purpose, and is preferably 0.5% by mass to 40% by mass, more preferably 1% by mass to 30% by mass and particularly preferably 2% by mass to 20% by mass.

When the amount is less than 0.5% by mass, the hot offset resistance is degraded, and it sometimes becomes difficult to balance the heat resistant storage stability and the fixing property at low temperature of the toner. When it exceeds 40% by mass, the fixing property at low temperature is sometimes degraded.

The polyisocyanate (PIC) is not particularly limited, can be appropriately selected depending on the purpose, and includes, for example, aliphatic polyisocyanate, alicyclic polyisocyanate, aromatic diisocyanate, aromatic aliphatic diisocyanate, isocyanurates, phenol derivatives thereof and those obtained by blocking them with oxime or caprolactam.

The aliphatic polyisocyanate includes, for example, tetramethylene diusocyanate, hexamethylene diusocyanate, 2,6-diisocyanatomethyl caproate, octamethylene diisocyanate, decamethylene diisocyanate, dodecamethylene diisocyanate, tetradecamethylene diisocyanate, trimethylhexane diisocyanate and tetramethylhexane diisocyanate. The alicyclic polyisocyanate includes, for example, isophorone diisocyanate and cyclohexylmethane diisocyanate. The aromatic diisocyanate includes, for example, trilene diisocyanate, diphenylmethane diisocyanate, 1,5-naphthylene dilsocyanate, diphenyl-4,4'-diisocyanate, 4,4'-disocyanato-3,3'-dimethyldiphenyl, 3-methyldiphenylmethane-4,4'-diisocyanate, and diphenyl ether-4,4'-diisocyanate. The aromatic aliphatic diisocyanate includes, for example, α,α,α',α'-tetramethylxylylene diisocyanate. The isocyanurates includes, for example, tris-isocyanatoalkyl-isocyanurate and triisocyanatocycloalkyl-isocyanurate. These may be used alone or in combination of two or more.

For the mixed ratio when the polyisocyanate (PIC) is reacted with the active hydrogen group-containing polyester resin (e.g., hydroxyl group-containing polyester resin), the mixed equivalent ratio ([NCO]/[OH]) of the isocyanate group [NCO] in the polyisocyanate (PIC) to the hydroxyl group [OH] in the hydroxyl group-containing polyester resin is preferably 5/1 to 1/1 typically, more preferably 4/1 to 1.2/1 and particularly preferably 3/1 to 1.5/1.

When this ratio exceeds 5/1, the fixing property at low temperature is sometimes degraded. When it is less than 1, the offset resistance is sometimes degraded.

The amount of the polyisocyanate (PIC) in the isocyanate group-containing polyester prepolymer (A) is not particularly limited, can be selected depending on the purpose, and is, for example, preferably 0.5% by mass to 40% by mass, more preferably 1% by mass to 30% by mass and still more preferably 2% by mass to 20% by mass.

When the amount is less than 0.5% by mass, the hot offset resistance is degraded, and it sometimes becomes difficult to balance the heat resistant storage stability and the fixing property at low temperature. When it exceeds 40% by mass, the fixing property at low temperature is sometimes degraded.

An average number of the isocyanate group contained per molecule of the isocyanate group-containing polyester prepolymers (A) is preferably one or more, more preferably 1.2 to 5 and still more preferably 1.5 to 4.

When the average number of the isocyanate groups is less than 1, the molecular weight of the polyester resin (RMPE) modified with the urea bond-generating group becomes low, and the hot offset resistance is sometimes degraded.

A mass average molecular weight (Mw) of the modified polyester resins capable of reacting with the active hydrogen group-containing compound is preferably 3,000 to 40,000 and more preferably 4,000 to 30,000 by a molecular weight distribution by GPC (gel permeation chromatography) of a fraction soluble in tetrahydrofuran (THF). When the mass average molecular weight (Mw) is less than 3,000, the heat resistant storage stability is sometimes degraded. When it exceeds 40,000, the fixing property at low temperature is sometimes degraded.

The molecular weight distribution can be measured, for example, as follows by gel permeation chromatography (GPC).

First, a column is stabilized in a heat chamber at 40° C. At this temperature, tetrahydrofuran (THF) is run at a flow rate of 1 ml/minute as a column solvent, and 50 μL to 200 μL of a resin sample solution in tetrahydrofuran adjusted at a sample concentration in the range of 0.05% by mass to 0.6% by mass is injected for measurement. Upon measurement of the molecular weight in the sample, the molecular weight distribution of the sample is calculated from the relation of logarithmic values of a standard curve made from several monodispersion polystyrene standard samples with counted numbers. As the standard polystyrene samples for making the standard curve, those having molecular weights of $6\times10^2$, $2.1\times10^2$, $4\times10^2$, $1.75\times10^4$, $1.1\times10^5$, $3.9\times10^5$, $8.6\times10^5$, $2\times10^6$, and $4.48\times10^6$ (manufactured by Pressure Chemical Co. or Toyo Soda Kogyo Co., Ltd.) are used, and it is preferable to use at least about 10 standard polystyrene samples. As a detector, an RI (refractive index) detector can be used.

[Aqueous Medium]

The aqueous medium is not particularly limited, can be appropriately selected from those known publicly and includes, for example, water, solvents miscible with the water, and mixtures thereof. Among them, the water is particularly preferable.

The solvent miscible with the water is not particularly limited as long as it is miscible with the water, and includes, for example, alcohol, dimethylformamide, tetrahydrofuran, cellsolves, and lower ketones.

The alcohol includes, for example, methanol, isopropanol, and ethylene glycol. The lower ketones include, for example, acetone and methylethylketone. These may be used alone or in combination of two or more.

The aqueous medium can be prepared, for example, by dispersing the resin fine particles in the aqueous medium. The resin fine particles may be the organic silicone resin fine particle of the present invention or other resin fine particles. The amount of the resin fine particles to be added into the aqueous medium is not particularly limited, can be appropriately selected depending on the purpose, and is preferably, for example, 0.5% by mass to 10% by mass.

The resin fine particle, even when it is those other than the organic silicone resin fine particle of the present invention, is not particularly limited as long as it can form an aqueous dispersion in the aqueous medium, can be appropriately selected from publicly known resins depending on the purpose, may be a thermoplastic resin or a thermosetting resin, and includes, for example, vinyl resins, polyurethane resins, epoxy resins, polyester resins, polyamide resins, polyimide resins, silicon resins, phenol resins, melamine resins, urea resins, aniline resins, ionomer resins, and polycarbonate resins.

These may be used alone or in combination of two or more. Among them, it is preferable to be formed of at least one selected from vinyl resins, polyurethane resins, epoxy resins, and polyester resins because the aqueous dispersion of fine spherical resin particles is easily obtained.

The vinyl resin is the polymer obtained by homopolymerizing or copolymerizing a vinyl monomer(s), and includes styrene-(meth)acrylate ester resins, styrene-butadiene copolymers, (meth)acrylic acid-acrylate ester polymers, styrene-acrylonitrile copolymers, styrene-maleic acid anhydrate, and styrene-(meth)acrylic acid copolymers.

As the resin fine particle, the copolymer including a monomer having at least two unsaturated groups and the organic silicone fine particle of the present invention can also be used. The monomer having at least two unsaturated groups is not particularly limited, can be appropriately selected depending on the purpose, and includes, for example, sodium salt of methacrylic acid ethylene oxide adduct sulfate ester ("ELEMINOL RS-30" manufactured by Sanyo Chemical Industries, Ltd.), divinyl benzene and 1,6-hexanediol acrylate.

The resin fine particle can be obtained by polymerizing according to the publicly known method appropriately selected depending on the purpose, and it is preferable to obtain as the aqueous dispersion of the resin fine particles. The method of preparing the aqueous dispersion of the resin fine particles suitably includes, for example, (1) the method of directly producing the aqueous dispersion of the resin fine particles using the vinyl monomer as a starting material using any polymerization method selected from a suspension polymerization method, an emulsification polymerization method, a seed polymerization method and a dispersion polymerization method in the case of the vinyl resin; (2) the method of producing the aqueous dispersion of the resin fine particles by dispersing a precursor (monomer, or oligomer) or a solvent solution thereof in the aqueous medium in the presence of an appropriate dispersant, and subsequently heating or adding a curing agent to cure, in the case of polyaddition resins or condensation resins such as the polyester resin, polyurethane resin, or epoxy resin; (3) the method of dissolving an appropriate emulsifier in the precursor (monomer, or oligomer) or the solvent solution thereof (preferably being a liquid or may be liquefied by heating) and subsequently adding water to emulsify with phase inversion, in the case of polyaddition resins or condensation resins such as the polyester resin, polyurethane resin, or epoxy resin; (4) the method of pulverizing the resin previously prepared by a polymerization reaction (may be any polymerization reaction type of addition polymerization, ring opening polymerization, polyaddition, addition condensation, and polycondensation) using a mechanically rotary or jet pulverizer, then classifying to yield the resin fine particles, and subsequently dispersing them in water in the presence of the appropriate dispersant; (5) the method of yielding the resin fine particles by atomizing/spraying a resin solution in which the resin previously prepared by a polymerization reaction (may be any polymerization reaction type of addition polymerization, ring opening polymerization, polyaddition, addition condensation and polycondensation) has been dissolved in a solvent and then dispersing them in water in the presence of the appropriate dispersant; (6) the method of precipitating the resin fine particles by adding a poor solvent to the resin solution in which the resin previously prepared by a polymerization reaction (may be any polymerization reaction type of addition polymerization, ring opening polymerization, polyaddition, addition condensation and polycondensation) has been dissolved in a solvent or cooling the resin solution in which the resin has been previously dissolved with heating in a solvent, subsequently removing the solvent to yield the resin fine particles, and then dispersing them in water in the presence of the appropriate dispersant; (7) the method of dispersing the resin solution in which the resin previously prepared by a polymerization reaction (may be any polymerization reaction type of addition polymerization, ring opening polymerization, polyaddition, addition condensation and polycondensation) has been dissolved in a solvent in the aqueous medium in the presence of the appropriate dispersant, and subsequently removing the solvent by heating or reducing pressure; and (8) the method of dissolving the appropriate emulsifier in the resin solution in which the resin previously prepared by a polymerization reaction (may be any polymerization reaction type of addition polymerization, ring opening polymerization, polyaddition, addition condensation and polycondensation) has been dissolved in a solvent, and subsequently adding the water to emulsify with phase inversion.

[Emulsification or Dispersion]

For emulsifying or dispersing the solution or the dispersion of the toner materials in the aqueous medium, it is preferable to disperse the solution or the dispersion of the toner materials with stirring in the aqueous medium. The dispersion method is not particularly limited, can be appropriately selected depending on the purpose, and can be performed, for example, using a known dispersing machine. The dispersing machine includes the low speed shearing dispersing machine and the high speed shearing dispersing machine.

The method of stably forming the dispersion body containing the polymer (e.g., the isocyanate group-containing polyester prepolymer (A)) capable of reacting with the active hydrogen group-containing compound in the aqueous medium includes, for example, the method of adding the solution or the dispersion of the toner materials prepared by dissolving or dispersing the toner materials, e.g., the prepolymer (e.g., the isocyanate group-containing polyester prepolymer (A)) capable of reacting with the active hydrogen group-containing compound, the colorant, the releasing agent, the charge controlling agent, and the unmodified polyester resin in the organic solvent in the aqueous medium, and dispersing them with a shearing force.

In the emulsification or dispersion, the amount of the aqueous medium to be used is preferably 50 parts by mass to 2,000 parts by mass and more preferably 100 parts by mass to 1,000 parts by mass relative to 100 parts by mass of the toner materials. When the amount to be used is less than 50 parts by mass, the dispersion of the toner materials is poor and the toner particle having the given particle diameter is not sometimes obtained. When it exceeds 2,000 parts by mass, production cost sometimes becomes high.

In the emulsification or dispersion, it is preferable to use a dispersant for stabilizing the oil drops and making the particle size distribution sharp with keeping the desired shape.

The dispersant is not particularly limited, can be appropriately selected depending on the purpose, and includes, for example, surfactants, water hardly soluble inorganic compound dispersants, and polymer based protection colloid. These may be used alone or in combination of two or more. Among them the surfactant is preferable.

The surfactant includes, for example, anion surfactants, cation surfactants, nonionic surfactants and ampholytic surfactants.

The anion surfactants include, for example, alkylbenzene sulfonate salts, α-olefin sulfonate salts and phosphate esters. Among them, those having fluoroalkyl group are suitably included. The anion surfactants having the fluoroalkyl group include, for example, fluoroalkyl carboxylic acids having 2 to 10 carbon atoms or metal salts thereof, disodium perfluorooctanesulfonyl glutamate, sodium 3-[omega-fluoroalkyl (C6 to 11) oxy]-1-alkyl (C3 to 4) sulfonate, sodium 3-[omega-fluoroalkanoyl (C6 to 8)-N-ethylamino]-1-propane sulfonate, fluoroalkyl (C11 to 20) carboxylic acids or metal salts thereof, perfluoroalkyl carboxylic acids (C7 to 13) or metal salts thereof, perfluoroalkyl sulfonic acids (C4 to 12) or metal salts thereof, perfluorooctane sulfonic acid diethanolamide, N-propyl-N-(2-hydroxyethyl) perfluorooctane sulfonamide, perfluoroalkyl (C6 to 10) sulfonamide propyltrimethyl ammonium salts, perfluoroalkyl (C6 to 10)-N-ethylsulfonyl glycine salts, and monoperfluoroalkyl (C6 to 16) ethyl phosphate ester. Commercially available surfactants having the fluoroalkyl group include, for example, Surflon S-111, S-112, and S-113 (manufactured by Asahi Glass Co., Ltd.), Fullard FC-93, FC-95, FC-98, and FC-129 (manufactured by Sumitomo 3M Ltd.), Unidain DS-101 and DS-102 (manufactured by Daikin Industries, Ltd.), Megafac F-110, F-120, F-113, F-191, F-812, and F-833 (manufactured by Dainippon Ink And Chemicals, Incorporated), F-Top EF-102, 103, 104, 105, 112, 123A, 123B, 306A, 501, 201, and 204 (manufactured by Tohchem Products Co., Ltd.), and Ftergent F-100 and F-150 (manufactured by Neos Corporation).

The cation surfactants include, for example, amine salt type surfactants and quaternary ammonium salt type cation surfactants. The amine salt type surfactants include, for example, alkylamine salts, amino alcohol fatty acid derivatives, polyamine fatty acid derivatives, and imidazoline. The quaternary ammonium salt type cation surfactants include, for example, alkyltrimethyl ammonium salts, dialkyldimethyl ammonium salts, alkyldimethylbenzyl ammonium salts, pyridinium salts, alkylisoquinolinium salts, and benzethonium chloride. Among the cation surfactants, aliphatic primary, secondary and tertiary amine acids having the fluoroalkyl group, aliphatic quaternary ammonium salts such as perfluoroalkyl (C6 to 10) sulfonamide propyltrimethyl ammonium salts, benzalkonium salts, benzethonium chloride, pyridinium salts, and imidazolium salts are included. Commercially available products of the cation surfactants include, for example, Surflon S-121 (manufactured by Asahi Glass Co., Ltd.), Fullard FC-135 (manufactured by Sumitomo 3M Ltd.), Unidain DS-202 (manufactured by Daikin Industries, Ltd.), Megafac F-150 and F-824 (manufactured by Dainippon Ink And Chemicals, Incorporated), F-Top EF-132 (manufactured by Tohchem Products Co., Ltd.) and Ftergent F-300(manufactured by Neos Corporation).

The nonionic surfactants include, for example, fatty acid amide derivatives and polyvalent alcohol derivatives.

The ampholytic surfactants include, for example, alanine, dodecyldi(aminoethyl)glycine, di(octylaminoethyl)glycine, and N-alkyl-N,N-dimethyl ammonium betaine.

In the preparation of the dispersion, a dispersion stabilizer can be used if necessary.

The dispersion stabilizer includes, for example, those such as calcium phosphate salt which are soluble in acid or alkali. When the dispersion stabilizer is used, the calcium phosphate salt can be removed by dissolving the calcium phosphate salt with the acid such as hydrochloric acid and washing with water or decomposing with an enzyme.

In the preparation of the dispersion, a catalyst for the extending reaction or the crosslinking reaction can be used. The catalyst includes, for example, dibutyl tin laurate and dioctyl tin laurate.

[Adhesive Base]

In the method of producing the toner base particle of the preferable aspect of the present invention, the adhesive base (the above resin) is generated by performing the extending reaction or the crosslinking reaction between the active hydrogen group-containing compound and the polymer capable of reacting with the active hydrogen group-containing compound upon the emulsification or dispersion The adhesive base exhibits an adhesiveness to the recording medium such as papers, contains at least an adhesive polymer obtained by reacting the active hydrogen group-containing compound with the polymer capable of reacting with the active hydrogen group-containing compound in the aqueous medium, and may further contain a binder resin appropriately selected from publicly known binder resins.

The mass average molecular weight of the adhesive bases is not particularly limited, can be appropriately selected depending on the purpose, and for example, is preferably 3,000 or more, more preferably 5,000 to 1,000,000, and particularly preferably 7,000 to 500,000.

When the mass average molecular weight is less than 3,000, the hot offset resistance is sometimes degraded.

The glass transition temperature (Tg) of the adhesive base is not particularly limited, can be appropriately selected depending on the purpose, and for example, is preferably 30° C. to 70° C. and more preferably 40° C. to 65° C. In the toner, since the polyester resin obtained by the crosslinking reaction or the extending reaction coexists, the toner exhibits the good storage stability even when the glass transition temperature is low compared with conventional polyester based toners.

When the glass transition temperature (Tg) is lower than 30° C., the heat resistant storage stability is sometimes degraded. When it is higher than 70° C., the fixing property at low temperature is sometimes insufficient.

The glass transition temperature can be measured, for example, using TG-DSC system TAS-100 (manufactured by Rigaku Denki Co., Ltd.) by the following method. First, about 10 mg of a sample is placed in a sample vessel made from aluminium, which is then placed on a holder unit and set in an electric furnace. The temperature is raised from the room temperature up to 150° C. at a temperature rising speed of 10° C./min, left stand at 150° C. for 10 minutes, then lowered to the room temperature and left stand for 10 minutes. DSC curve measurement was performed using a differential scanning calorimeter (DSC) by subsequently heating again up to 150° C. at a temperature rising speed of 10° C./minute under nitrogen atmosphere. The glass transition temperature (Tg) can be calculated from a tangent of an endothermic curve in the vicinity of the glass transition temperature (Tg) and a contact point with a base line using the analysis system in TG-DSC system TAS-100 system.

Specific examples of the adhesive base are not particularly limited, can be appropriately selected depending on the purpose, and particularly suitably include polyester based resins.

The polyester based resins are not particularly limited, can be appropriately selected depending on the purpose, and particularly suitably include, for example urea modified polyester based resins.

The urea modified polyester based resin is obtained by reacting amines (B) as the active hydrogen group-containing compound with the isocyanate group-containing polyester prepolymer (A) as the polymer capable of reacting with the active hydrogen group-containing compound in the aqueous medium.

The urea modified polyester based resin may contain an urethane bond in addition to the urea bond. In this case, a molar content ratio of the urea bond to the urethane bond (urea bond/urethane bond) is not particularly limited, can be appropriately selected depending on the purpose, and is preferably 100/0 to 10/90, more preferably 80/20 to 20/80 and particularly preferably 60/40 to 30/70. When the urea bond is less than 10, the hot offset resistance is sometimes degraded.

Specific examples of the urea modified polyester resin suitably include the following (1) to (10), i.e., (1) a mixture of one obtained by ureating with isophoronediamine a polyester prepolymer obtained by reacting a polycondensate of a bisphenol A ethylene oxide 2 mol adduct and isophthalic acid to isophorone diisocyanate, with the polycondensate of the bisphenol A ethylene oxide 2 mol adduct and isophthalic acid; (2) a mixture of one obtained by ureating with isophoronediamine a polyester prepolymer obtained by reacting a polycondensate of a bisphenol A ethylene oxide 2 mol adduct and isophthalic acid to isophorone diisocyanate, with a polycondensate of the bisphenol A ethylene oxide 2 mol adduct and terephthalic acid; (3) a mixture of one obtained by ureating with isophoronediamine a polyester prepolymer obtained by reacting a polycondensate of a bisphenol A ethylene oxide 2 mol adduct/bisphenol A propylene oxide 2 mol adduct and terephthalic acid to isophorone diisocyanate, with the polycondensate of the bisphenol A ethylene oxide 2 mol adduct/bisphenol A propylene oxide 2 mol adduct and terephthalic acid; (4) a mixture of one obtained by ureating with isophoronediamine a polyester prepolymer obtained by reacting a polycondensate of a bisphenol A ethylene oxide 2 mol adduct/bisphenol A propylene oxide 2 mol adduct and terephthalic acid to isophorone diisocyanate, with a polycondensate of the bisphenol A propylene oxide 2 mol adduct and terephthalic acid; (5) a mixture of one obtained by ureating with hexamethylenediamine a polyester prepolymer obtained by reacting a polycondensate of a bisphenol A ethylene oxide 2 mol adduct and terephthalic acid to isophorone diisocyanate, with the polycondensate of the bisphenol A ethylene oxide 2 mol adduct and terephthalic acid; (6) a mixture of one obtained by ureating with hexamethylenediamine a polyester prepolymer obtained by reacting a polycondensate of a bisphenol A ethylene oxide 2 mol adduct and terephthalic acid to isophorone diisocyanate, with the polycondensate of the bisphenol A ethylene oxide 2 mol adduct/bisphenol A propylene oxide 2 mol adduct and terephthalic acid; (7) a mixture of one obtained by ureating with ethylenediamine a polyester prepolymer obtained by reacting a polycondensate of a bisphenol A ethylene oxide 2 mol adduct and terephthalic acid to isophorone diisocyanate, with the polycondensate of the bisphenol A ethylene oxide 2 mol adduct and terephthalic acid; (8) a mixture of one obtained by ureating with hexamethylenediamine a polyester prepolymer obtained by reacting a polycondensate of a bisphenol A ethylene oxide 2 mol adduct and isophthalic acid to diphenylmethane diisocyanate, with the polycondensate of the bisphenol A ethylene oxide 2 mol adduct and isophthalic acid; (9) a mixture of one obtained by ureating with hexamethylenediamine a polyester prepolymer obtained by reacting a polycondensate of a bisphenol A ethylene oxide 2 mol adduct/bisphenol A propylene oxide 2 mol adduct and terephthalic acid/docenyl succinic acid anhydrate to diphenylmethane diisocyanate, with the polycondensate of the bisphenol A ethylene oxide 2 mol adduct/bisphenol A propylene oxide 2 mol adduct and terephthalic acid; and (10) a mixture of one obtained by ureating with hexamethylenediamine a polyester prepolymer obtained by reacting a polycondensate of a bisphenol A ethylene oxide 2 mol adduct and isophthalic acid to toluene diisocyanate, with the polycondensate of the bisphenol A ethylene oxide 2 mol adduct and isophthalic acid.

The adhesive base (e.g., the urea modified polyester resin), for example, (1) may be generated by emulsifying or dispersing the solution or the dispersion of the toner materials including the polymer (e.g., the isocyanate group-containing polyester prepolymer (A)) capable of reacting with the active hydrogen group-containing compound together with the active hydrogen group-containing compound (e.g., the amines (B)) in the aqueous medium to form the oil drops, and subjecting both to the extending reaction or the crosslinking reaction in the aqueous medium; (2) may be generated by emulsifying or dispersing the solution or the dispersion of the toner materials in the aqueous medium in which the active hydrogen group-containing compound has been previously added to form the oil drops, and subjecting both to the extending reaction or the crosslinking reaction in the aqueous medium; and (3) may be generated by adding and mixing the solution or the dispersion of the toner materials in the aqueous medium, subsequently adding the active hydrogen group-containing compound to form the oil drops and subjecting both to the extending reaction or the crosslinking reaction from a particle interface in the aqueous medium. In the above (3), the modified polyester resin is preferentially generated on the surface of the toner generated, and thus a density gradient can also be provided in the toner particles.

A reaction condition for generating the adhesive base by the emulsification or dispersion is not particularly limited, and can be appropriately selected depending on the combination of the polymer capable of reacting with the active hydrogen group-containing compound and the active hydrogen group-containing compound. A reaction time period is preferably 10 minutes to 40 hours and more preferably 2 hours to 24 hours.

[Other Binder Resins]

In the present invention, other binder resin may be preferably used at the same time. Other binder resin is not particularly limited, can be appropriately selected depending on the purpose, and includes, for example, polyester resins. In particular, the unmodified polyester resin (polyester resin which is not modified) is preferable.

When the unmodified polyester resin is contained in the toner base particle, the fixing property at low temperature and the glossiness can be enhanced.

The unmodified polyester resin includes the same ones as in the urea bond generating group-containing polyester resin, i.e., the polycondensates of polyol (PO) and polycarboxylic acid (PC). The unmodified polyester resin is preferable in terms of fixing property at low temperature and hot offset resistance because the unmodified polyester resin is partially compatible with the urea bond generating group-containing polyester based resin (RMPE), i.e., they have a similar structure which enables them to be compatible partially with each other.

The mass average molecular weight (Mw) of the unmodified polyester resins is preferably 1,000 to 30,000 and more preferably 1,500 to 15,000 by the molecular weight distribution by GPC (gel permeation chromatography) of the fraction soluble in tetrahydrofuran (THF). When the mass average molecular weight (Mw) is less than 1,000, the heat resistant storage stability is sometimes degraded. Thus, it is preferable that the amount of the components having the mass average molecular weight (Mw) of less than 1,000 is 8% by mass to 28% by mass. Meanwhile, when the mass average molecular weight exceeds 30,000, the fixing property at low temperature is sometimes degraded.

The glass transition temperature of the unmodified polyester resin is preferably 35° C. to 70° C. When the glass transition temperature is lower than 35° C., the heat resistant storage stability of the toner is sometimes degraded. When it is higher than 70° C., the fixing property at low temperature is sometimes insufficient.

A hydroxyl group value of the unmodified polyester resin is preferably 5 mg KOH/g or more, more preferably 10 mg KOH/g to 120 mg KOH/g, and still more preferably 20 mg KOH/g to 80 mg KOH/g. When the hydroxyl group value is less than 5 mg KOH/g, it sometimes becomes difficult to balance the heat resistant storage stability and the fixing property at low temperature.

An acid value of the unmodified polyester resin is preferably 1.0 mg KOH/g to 30.0 mg KOH/g and more preferably 5.0 mg KOH/g to 20.0 mg KOH/g. Generally by making the toner have the more acid value, the toner is the more easily charged negatively.

When the unmodified polyester resin is contained in the toner, the mixed mass ratio (RMPE/PE) of the urea bond generating group-containing polyester resin (RMPE) to the unmodified polyester resin (PE) is preferably 5/95 to 25/75 and more preferably 10/90 to 25/75.

When the mixed mass ratio of the unmodified polyester resin exceeds 95, the hot offset resistance is sometime degraded. When it is less than 75, the fixing property at low temperature and glossiness of the image are sometimes degraded.

[Separation and Yield of Toner Base Particle]

The organic solvent is removed from the emulsified slurry obtained in the emulsification or the dispersion.

The method of removing the organic solvent includes, for example, (1) the method of removing by raising gradually the temperature in the entire reaction system to completely evaporate the organic solvent in the oil drops and (2) the method of completely removing the water insoluble organic solvent in the oil drops to form the toner base particles by spraying the emulsified dispersion body in a dried atmosphere and simultaneously evaporating/removing the aqueous dispersant.

When the organic solvent is removed, the toner base particle is formed. The toner base particle can be washed and dried. Subsequently, the classification can be performed as desired. The classification can be performed by removing the fine particle portion in liquid by cyclone, decanter or centrifugation. The classification may be performed after acquiring the powder after the drying.

By mixing the resulting toner base particle together with the particles of the colorant, the releasing agent and the charge controlling agent or by further applying a mechanical impact force, it is possible to prevent the particles such as the releasing agent from dissociating from the surface of the toner particles.

The method of applying the mechanical impact force includes the method of applying the impact force to the mixture using blades which rotate at high speed, and the method of placing the mixture in high speed gas flow and crashing the particles one another or the complexed particles to an appropriate crash plate by accelerating. An apparatus used for this method includes Ang Mill (manufactured by Hosokawa Micron Ltd.), an apparatus in which a pulverization air pressure has been reduced by remodeling I type mill (manufactured by Nippon Pneumatic MFG. Co., Ltd.), a hybridization system (Nara Machinery Co., Ltd.), a cryptron system (manufactured by Kawasaki Heavy Industries, Ltd.), and an automatic mortar.

[Production of Toner Base Particle in Case of Using Suspension Polymerization Method]

The toner base particle produced by the suspension polymerization method will be described below.

The toner base particle produced by the suspension polymerization method can be obtained by emulsifying or dispersing (suspending) the solution or the dispersion of the toner materials in the aqueous medium to prepare the emulsion or the dispersion (suspension), and then by granulating the toner as described above.

[Solution or Dispersion of Toner Materials]

In the suspension polymerization method, the solution or the dispersion of the toner materials is obtained by dissolving or dispersing the fixing aid, the colorant, further if necessary, components, e.g., the wax, the charge controlling agent, and the crosslinking agent in a polymerizable monomer and an oil soluble polymerization initiator. In addition, for example, in order to reduce the viscosity in the polymer produced in the polymerization reaction described later, the organic solvent, a macromolecular polymer and the dispersant may be appropriately added.

A functional group can be introduced to the toner particle surface by partially using as a polymerizable monomer acids such as acrylic acid, methacrylic acid, α-cyanoacrylic acid, α-cyanomethacrylic acid, itaconic acid, crotonic acid, fumaric acid, maleic acid, and maleic acid anhydrate; acrylamide, methacrylamide, diacetone acrylamide or the methylol compounds thereof; vinyl pyridine, vinyl pyrrolidone, vinyl imidazole, ethylene imine, acrylate or methacrylate having an amino group such as diethylaminoethyl methacrylate. The dispersant can be adsorbed and left onto the toner particle surface to introduce the functional group by appropriately selecting one having an acid group or a basic group as the dispersant to be used.

The polymerizable monomer includes, for example, styrene based monomers such as styrene, o-methylstyrene, m-methylstyrene, p-methylstyrene, p-methoxystyrene, and p-ethylstyrene; acrylate esters such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate and phenyl acrylate; methacrylate esters such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; other acrylonitrile, methacrylonitrile, and acrylamide.

The resin can also be used in addition to the polymerizable monomer. For example, the polymerizable monomer is water soluble, is dissolved in the aqueous suspension and the emulsification polymerization can not be performed. Thus, when the polymerizable monomer which contains the hydrophilic functional group such as an amino group, a carboxylate group, a hydroxyl group, a sulfone group, a glycidyl group, or a nitrile group is introduced in the toner, the resin which is the copolymer such as a random copolymer, a block copolymer, or a graft copolymer of a vinyl compound (such as styrene or ethylene) therewith, or the polycondensate of polyester or polyamide therewith, or the polyaddition polymer of polyether or polyimine therewith can be used.

The alcohol component and the acid component which form the polyester resin include the followings.

The alcohol component includes, for example, ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, cyclohexane dimethanol, butenediol, octenediol, cyclohexene dimethanol and hydrogenated bisphenol A. Polyvalent alcohol such as glycerine, pentaerythritol, sorbit, sorbitan and oxyalkylene ether of novolak type phenol resins may also be used.

The acid component includes, for example, benzene dicarboxylic acids such as phthalic acid, terephthalic acid, and isophthalic acid or anhydrates thereof; alkyl dicarboxylic acids such as succinic acid, adipic acid, sebacic acid, and azelaic acid or anhydrates thereof; succinic acid substituted with an alkyl group or an alkenyl group having 6 to 18 carbon atoms or anhydrates thereof; and unsaturated dicarboxylic acids such as fumaric acid, maleic acid, citraconic acid, and itaconic acid or anhydrates thereof as bivalent carboxylic acids. Polyvalent carboxylic acids such as trimellitic acid, pyromellitic acid, 1,2,3,4-butane tetracarboxylic acid, and benzophenone tetracarboxylic acid and anhydrates thereof may also be used.

The amounts of the alcohol component and the acid component in the polyester resin are preferably 45 mol % to 55 mol % and 55 mol % to 45 mol %, respectively.

Two or more of the polyester resins may be used in combination as long as no harmful effect is given to physical properties of the toner base particle obtained. Further, the physical properties can be adjusted by modifying with silicone or a fluoroalkyl group-containing compound.

When a macromolecular polymer containing such a polar functional group is used here, the average molecular weight of the macromolecular polymers is preferably 5,000 or more.

Furthermore, in addition to the polymerizable monomer, the resins shown below may be used. The resins include, for example, homopolymers of styrene and substituents thereof, e.g., polystyrene and polyvinyl toluene; styrene based copolymers such as styrene-propylene copolymers, styrene-vinyl toluene copolymers, styrene-vinyl naphthaline copolymers, styrene-methyl acrylate copolymers, styrene-ethyl acrylate copolymers, styrene-butyl acrylate copolymers, styrene-octyl acrylate copolymers, styrene-dimethylaminoethyl acrylate copolymers, styrene-methyl methacrylate copolymers, styrene-ethyl methacrylate copolymers, styrene-butyl methacrylate copolymers, styrene-dimethylaminoethyl methacrylate copolymers, styrene-vinyl methyl ether copolymers, styrene-vinyl ethyl ether copolymers, styrene-vinyl methyl ketone copolymers, styrene-butadiene copolymers, styrene-isoprene copolymers, styrene-maleic acid copolymers and styrene maleate ester copolymers; polymethyl methacrylate, polybutyl methacrylate, polyvinyl acetate, polyethylene, polypropylene, polyvinyl butyral, silicone resins, polyester resins, polyamide resins, epoxy resins, polyacrylic acid resins, rosin, modified rosin, terpene resins, phenol resins, aliphatic or alicyclic hydrocarbon resins, and aromatic petroleum resins. These may be used alone or in combination of two or more.

The amount of the resin to be added is preferably 1 part by mass to 20 parts by mass relative to 100 parts by mass of the polymerizable monomer. When the amount to be added is less than 1 part by mass, no effect by its addition sometimes occurs on the adjustment of the physical properties of the toner particles. When it exceeds 20 parts by mass, it sometimes becomes difficult to design the physical properties of the toner particles. The polymer having the different molecular weight from the molecular weight range of the toner obtained by polymerizing the polymerizable monomer can also be dissolved in and polymerized with the polymerizable monomer.

When the polymerization reaction is performed using 0.5 parts by mass to 20 parts by mass of the oil soluble polymerization initiator having a half life of 0.5 hours to 30 hours upon polymerization reaction relative to 100 parts by mass of the polymerizable monomer, it is possible to yield the polymer having the maximum molecular weight between 10,000 to 100,000, and impart the desirable strength and the appropriate solubility to the toner.

The oil soluble polymerization initiator is not particularly limited as long as it is oil soluble, can be appropriately selected depending on the purpose, and includes, for example, azo based or diazo based polymerization initiators such as 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile and azobisisobutyronitrile; and peroxide based polymerization initiators such as benzoyl peroxide, methylethylketone peroxide, diisopropyl peroxycarbonate, cumenehydro peroxide, 2,4-dichlorobenzoyl peroxide, lauroyl peroxide and t-butylperoxy-2-ethylhexanoate.

The crosslinking agent is not particularly limited, can be appropriately selected depending on the purpose, compounds mainly having two or more polymerizable double bonds can be suitably used, and for example, aromatic divinyl compounds such as divinyl benzene and divinyl naphthalene; carboxylate ester having two double bonds such as ethylene glycol diacrylate, ethylene glycol dimethacrylate, and 1,3-butanediol dimethacrylate; divinyl compounds such as divinyl aniline, divinyl ether, divinyl sulfide and divinyl sulfone; and compounds having 3 or more vinyl groups. These may be used alone or in combination of two or more.

The amount of the crosslinking agent to be added is preferably 0.01 parts by mass to 15 parts by mass relative to 100 parts by mass of the polymerizable monomer.

The aqueous medium is not particularly limited, can be appropriately selected depending on the purpose, and includes, for example water.

It is preferable that the aqueous medium contains a dispersion stabilizer.

As the dispersion stabilizer, for example, it is possible to use publicly known surfactants, organic dispersants and inorganic dispersants. Among them, the inorganic dispersant is preferable because harmful ultrafine particles are hardly produced, the dispersion stability is obtained by steric hindrance, thus the stability is kept even when the reaction temperature is changed, washing is easy and no harmful effect is given to the toner.

The inorganic dispersant includes, for example, polyvalent phosphate metal salts such as calcium phosphate, magnesium phosphate, aluminium phosphate, and zinc phosphate; carbonate salts such as calcium carbonate and magnesium carbonate; inorganic salts such as calcium metasilicate, calcium sulfate and barium sulfate; inorganic oxides such as calcium hydroxide, magnesium hydroxide, aluminium hydroxide, silica, bentonite and alumina.

The inorganic dispersant can be directly used, but in order to obtain finer particles, the inorganic dispersant particles may be generated and used in the aqueous medium. For example, in the case of the calcium phosphate, water insoluble calcium phosphate can be generated by mixing an aqueous solution of sodium phosphate and an aqueous solution of calcium chloride under stirring at high speed, and the more homogenous and finer dispersion becomes possible. At that time, a water soluble sodium chloride salt is produced simultaneously. This is preferable because when the water soluble salt is present in the aqueous medium, the dissolution of the polymerizable monomer in water is inhibited and ultrafine toner particles due to the emulsification polymerization are hardly produced. However, this becomes an obstacle when the remaining polymerizable monomer is removed at the end of the polymerization reaction. Thus, it is preferable to exchange the aqueous medium or perform desalting using an ion exchange resin. The inorganic dispersant can be nearly completely removed by dissolving with acid or alkali after the completion of the polymerization.

It is preferable that 0.2 parts by mass to 20 parts by mass of the inorganic dispersant alone is used relative to 100 parts by mass of the polymerizable monomer. When the inorganic dispersant is used, although the ultrafine particles are hardly produced, the toner having the small particle diameter is also hardly obtained. Thus it is preferable to use 0.001 parts by mass to 0.1 parts by mass of the surfactant in combination.

The surfactant includes, for example, sodium dodecylbenzene sulfate, sodium tetradecyl sulfate, sodium pentadecyl sulfate, sodium octyl sulfate, sodium oleate, sodium laurate, sodium stearate and potassium stearate.

The suspension is performed by emulsifying or dispersing the solution or the dispersion in which the toner materials have been uniformly dissolved or dispersed in the aqueous medium. At that time, the toner having a sharp particle size distribution is obtained by dispersing to the desired size of the toner particle at once using a high speed dispersing machine such as a high speed agitator or an ultrasonic dispersing machine.

The oil soluble polymerization initiator may be added simultaneously with the addition of other additives in the polymerizable monomer, or may be mixed just before suspending the solution or the dispersion of the toner materials in the aqueous medium. Alternatively, the oil soluble polymerization initiator dissolved in the polymerizable monomer or the solvent can also be added during or immediately after the granulation of the toner or before starting the polymerization reaction.

The granulation is performed by polymerizing the polymerizable monomer.

The temperature in the polymerization reaction is for example 40° C. or above, and generally 50° C. to 90° C. When the polymerization is performed at the temperature range, the releasing agent and the wax to be present inside the toner particle can be precipitated by phase separation and enfolded in the particle. In order to consume the remaining polymerizable monomer, the reaction temperature is sometimes set at 90° C. to 150° C. However, as described above, when heated to the temperature equal to or higher than the melting point of the fixing aid, the resin and the fixing aid become compatible. Thus, it is necessary to react at the temperature lower than the melting point of the fixing aid. Specifically, it is preferable to react at 100° C. or below.

The seed polymerization method in which the polymerizable monomer is further adsorbed to the resulting polymerized particles, and subsequently the polymerization is performed using the oil soluble polymerization initiator can also be used in the above granulation. At that time, the compound having a polarity can also be dissolved or dispersed in the polymerizable monomer to be adsorbed to use.

After the completion of the polymerization reaction, it is preferable to stir at a stirring speed at which a particle state is kept and suspension or precipitation of the particles is prevented using an ordinary stirrer.

The toner particle is obtained by filtrating and washing the polymerized particle after the completion of the polymerization reaction to remove the redundant surfactant, drying, and further mixing with the inorganic powder to adhere onto the particle surface. At that time, it is preferable to remove rough powders and fine powders by classifying.

[Fine Organic Silicone Particle]

The organic silicone fine particle of the present invention is made of a hemispheric polysiloxane cross-linked structure. The polysiloxane cross-linked structure is composed of two or more siloxane units selected from the siloxane units each expressed by the following Formula 1, and has an average siloxane unit expressed by the following Formula 2.

$$R1mSiO(4-m)/2 \qquad \text{Formula 1}$$

$$R2nSiO(4-n)/2 \qquad \text{Formula 2}$$

(wherein, R1 and R2 are organic groups having a carbon atom directly connected to a Si atom, m is an integer and is particularly preferably from 0 to 3, n is in particularly preferably from 0.40 to 0.77).

Among them, particularly the polysiloxane cross-linked structure composed of a first siloxane unit of Formula 1 with m being 0 and a second siloxane unit of Formula 1 with m being 1, and having a molar ratio [the first siloxane unit]/[the second siloxane unit] of 23/77 to 40/60 is more preferable.

These are preferably methyl silicones (methylphenyl silicone, and in particular dimethyl silicone where the both R1 groups are a methyl group in Formula 1)

The organic silicone fine particles of the present invention preferably have a volume average particle diameter obtained by measurement according to Coulter principle of 0.05 μm to 6.0 μm.

The amount of the organic silicone fine particle to be added in the colored particle (the toner base) is not particularly limited and can be appropriately selected depending on the purpose.

The mechanism by which a hemispheric organic fine particle of the present invention is produced is inferred as follows.

(1) By hollowing of a particulate emulsion, hollow emulsion particles are formed.

(2) When the emulsion is composed of a monomer, a polymerization initiator is added as required to harden the surface of the emulsion particles and to form a shell on the surface thereof, and a hollow organic fine particles are produced.

(3) At the same time as the process of (2), the temperature is adjusted so that the hollow particles burst due to expansion of gas inside the organic fine particles or vaporization of liquid inside the particles, and then the gas inside the hollow particles is evacuated.

Concave hemispheric organic fine particles, which resemble deflated rubber balls, are possibly obtained by allowing hollow organic fine particles to burst under relatively mild conditions.

Not all the hollow organic fine particles yield such hemispheric organic fine particles, however, the hemispheric organic fine particles can be easily separated from indefinitely formed is particles resulting from complete burst by air classification treatment, because of the difference in behavior as powders.

To obtain a hemispheric organic silicone fine particle, the following method can be used, as is described in Examples of the present invention. The method is consisted of at least (A) adding step, in the presence of at least one type of hydrolysis catalyst (a surfactant is added as required), of a compound represented by a formula of $SiX_4$ and a compound represented by a formula of $RSiY_3$ (wherein X and Y are independently, C1-C4 alkoxy group, alkoxyethoxy group containing C1-C4 alkoxy group, C2-C4 acyloxy group, N,N-dialkylamino group containing C1-C4 alkyl group, hydroxyl group, halogen atom or hydrogen atom, and R is an organic group containing a carbon atom directly bound to the silicon atom) into an aqueous medium, and (B) contacting step of the mixture obtained from the adding step (A) with an aqueous solution containing at least one type of polymerized catalyst (a surfactant is added as required) at a temperature in the range of 30° C. to 80° C., for at least 2 hr.

By introducing a polymerized catalyst, under a basic condition and at a low temperature, to the mixture obtained at the adding step (A), a hollow hemisphere like a bowl with a round bottom is formed.

To obtain further hemispheric fine particles made of materials other than organic silicone, the method with steps (1) to (3) described above can be used.

The following method can be used as a further generalized method applicable to various materials to form hollow emulsion particles.

According to Henry's law, solubility of a gas in a liquid is proportional to the pressure of the gas. According to this characteristic, when emulsion particles under pressurization containing liquid fine particles in which gases are dissolved by pressure are depressurized to normal pressure, air bubbles are generated in the liquid fine particles making up the emulsion particles, and hollow emulsion particles are formed.

After such hollow emulsion particles are formed, a polymerization initiator is added to make shells of the particles. Hollow organic fine particles are thus obtained. Then by appropriately adjusting the temperature and making hollow organic fine particles burst and evacuating gases inside the hollow organic fine particles using a phenomenon of expansion of gases inside the hollow organic fine particles or of vaporization of liquid inside the hollow organic fine particles, hemispheric organic fine particles can be obtained.

This method is applicable to every resin available as an external additive for toners, because it can produce hemispheric organic fine particles without including a polymerization step using a monomer. For example, hollow particles of polyethylene or polyvinyl acetate are easily formed by dissolving polyvinyl acetate or polyethylene in an organic solvent and by using water as a dispersion medium, forming hollow particles at the same time as hardening surfaces of the hollow particles. Hemispheric organic fine particles are obtained from these hollow organic fine particles, by appropriately adjusting the temperature and making hollow organic fine particles burst and evacuating gases inside the hollow organic fine particles using a phenomenon of expansion of gases inside the hollow organic fine particles or of vaporization of liquid inside the hollow organic fine particles.

Hemispheric organic fine particles can be prepared according to the following method in addition to the above method using Henry's law.

Emulsion particles with liquid remaining inside can be prepared, by dissolving a resin in a solvent at a concentration near the saturated concentration, using water as a dispersion medium to form an emulsion, and adjusting the temperature of the emulsion so that surfaces of the emulsion particles harden. Hemispheric organic fine particles are obtained from these emulsion particles with liquid part inside by further heating the emulsion particles and evacuating the liquid inside.

[Other External Additives]

The external additive in addition to the organic silicone fine particle used in the present invention is not particularly limited, can be appropriately selected depending on the purpose, and includes for example, silica (medium, small particle diameters), titanium compounds, alumina, cerium oxide, calcium carbonate, magnesium carbonate, calcium phosphate, fluorine-containing resin fine particles, silica-containing resin fine particles, and nitrogen-containing resin fine particles. These may be used alone or in combination of two or more.

[Titanium Compound]

Other external additive preferably contains a titanium compound, and it is more preferable to obtain the titanium compound by reacting a part or all of $TiO(OH)_2$ produced by the wet system with the silane compound or the silicone oil.

As the silane compound, a silane coupling agent is suitably used. The silane coupling agent includes, for example, $CH_3Si(Cl)_3$, $CH_3Si(OCH_3)_3$, $CH_3Si(OC_2H_5)_3$, $CH_3CH_2Si(OCH_3)_3$, $CH_3(CH_2)_2Si(OCH_3)_3$, $CH_3(CH_2)_3Si(OCH_3)_3$, $CH_3(CH_2)_4Si(OCH_3)_3$, $CH_3(CH_2)_5Si(OCH_3)_3$, $CH_3(CH_2)_6Si(OCH_3)_3$, $CH_3(CH_2)_7Si(OCH_3)_3$, $CH_3(CH_2)_8Si(OCH_3)_3$, $CH_3(CH_2)_9Si(OCH_3)_3$, $CH_3(CH_2)_{10}Si(OCH_3)_3$, $CH_3(CH_2)_{11}Si(OCH_3)_3$, $CH_3(CH_2)_{12}Si(OCH_3)_3$, $CH_3(CH_2)_{13}Si(OCH_3)_3$, $CH_3(CH_2)_{14}Si(OCH_3)_3$, $CH_3(CH_2)_{15}Si(OCH_3)_3$, $CH_3(CH_2)_{16}Si(OCH_3)_3$, $CH_3(CH_2)_{17}Si(OCH_3)_3$, $CH_3(CH_2)_{18}Si(OCH_3)_3$, $CH_3(CH_2)_{19}Si(OCH_3)_3$, $CH_3(CH_2)_5Si(OC_2H_5)_3$, $CH_3(CH_2)_6Si(OC_2H_5)_3$, $CH_3(CH_2)_7Si(OC_2H_5)_3$, $CH_3(CH_2)_8Si(OC_2H_5)_3$, $CH_3(CH_2)_9Si(OC_2H_5)_3$, $CH_3(CH_2)_{10}Si(OC_2H_5)_3$, $CH_3(CH_2)_{11}Si(OC_2H_5)_3$, $CH_3(CH_2)_{12}Si(OC_2H_5)_3$, $CH_3(CH_2)_{13}Si(OC_2H_5)_3$, $CH_3(CH_2)_{14}Si$ $(OC_2H_5)_3$, $CH_3(CH_2)_{15}Si(OC_2H_5)_3$, $CH_3(CH_2)_{16}Si(OC_2H_5)_3$, $CH_3(CH_2)_{17}Si(OC_2H_5)_3$, $CH_3(CH_2)_{18}Si(OC_2H_5)_3$, $CH_3(CH_2)_{19}Si(OC_2H_5)_3$, $CF_3Si(OCH_3)_3$, $CH_3Si(NCO)_3$, $(CH_3)_2SiCl_2$, $(CH_3)_2Si(OCH_3)_2$, $(CH_3)_2Si(OC_2H_5)_2$, $(CH_3)(CH_3CH_2)Si(OCH_3)_2$, $(CH_3)[CH_3(CH_2)_2]Si(OCH_3)_2$, $(CH_3)[CH_3(CH_2)_3]Si(OCH_3)_2$, $(CH_3)[CH_3(CH_2)_4]Si(OCH_3)_2$, $(CH_3)[CH_3(CH_2)_5]Si(OCH_3)_2$, $(CH_3)[CH_3(CH_2)_6]Si(OCH_3)_2$, $(CH_3)[CH_3(CH_2)_7]Si(OCH_3)_2$, $(CH_3)[CH_3(CH_2)_8]Si(OCH_3)_2$, $(CH_3)[CH_3(CH_2)_9]Si(OCH_3)_2$, $(CH_3)[CH_3(CH_2)_{10}]Si(OCH_3)_2$, $(CH_3)[CH_3(CH_2)_{11}]Si(OCH_3)_2$, $(CH_3)[CH_3(CH_2)_{12}]Si(OCH_3)_2$, $(CH_3)[CH_3(CH_2)_{13}]Si(OCH_3)_2$, $(CH_3)[CH_3(CH_2)_{14}]Si(OCH_3)_2$, $(CH_3)[CH_3(CH_2)_{15}]Si(OCH_3)_2$, $(CH_3)[CH_3(CH_2)_{16}]Si(OCH_3)_2$, $(CH_3)[CH_3(CH_2)_{17}]Si(OCH_3)_2$, $(CH_3)[CH_3(CH_2)_{18}]Si(OCH_3)_2$, $(CH_3)[CH_3(CH_2)_{19}]Si(OCH_3)_2$, $(CH_3)_2Si(NCO)_2$, $(CH_3)_3SiCl$, $(CH_3)_3Si(OCH_3)$, $(CH_3)_3Si(OC_2H_5)$, $(CH_3)_2(CH_3CH_2)Si(OCH_3)$, $(CH_3)_2[CH_3(CH_2)_2]Si(OCH_3)$, $(CH_3)_2[CH_3(CH_2)_3]Si(OCH_3)$, $(CH_3)_2[CH_3(CH_2)_4]Si(OCH_3)$, $(CH_3)_2[CH_3(CH_2)_5]Si(OCH_3)$, $(CH_3)_2[CH_3(CH_2)_6]Si(OCH_3)$, $(CH_3)_2[CH_3(CH_2)_7]Si(OCH_3)$, $(CH_3)_2[CH_3(CH_2)_8]Si(OCH_3)$, $(CH_3)_2[CH_3(CH_2)_9]Si(OCH_3)$, $(CH_3)_2[CH_3(CH_2)_{10}]Si(OCH_3)$, $(CH_3)_2[CH_3(CH_2)_{11}]Si(OCH_3)$, $(CH_3)_2[CH_3(CH_2)_{12}]Si(OCH_3)$, $(CH_3)_2[CH_3(CH_2)_{13}]Si(OCH_3)$, $(CH_3)_2[CH_3(CH_2)_{14}]Si(OCH_3)$, $(CH_3)_2[CH_3(CH_2)_{15}]Si(OCH_3)$, $(CH_3)_2[CH_3(CH_2)_{16}]Si(OCH_3)$, $(CH_3)_2[CH_3(CH_2)_{17}]Si(OCH_3)$, $(CH_3)_2[CH_3(CH_2)_{18}]Si(OCH_3)$ and $(CH_3)_2[CH_3(CH_2)_{19}]Si(OCH_3)$.

The silicone oil includes, for example, dimethyl silicone oils, methylphenyl silicone oils, chlorophenyl silicone oils, methylhydrogen silicone oils, alkyl modified silicone oils, fluorine modified silicone oils, polyether modified silicone oils, alcohol modified silicone oils, amino modified silicone oils, epoxy modified silicone oils, epoxy polyether modified silicone oils, phenol modified silicone oils, carboxyl modified silicone oils, mercapto modified silicone oils, (meth)acryl modified silicone oils, and α-methylstyrene modified silicone oils.

The above reaction includes the method of immersing $TiO(OH)_2$ in the solution of these materials and drying. The treatment with the coupling agent includes, for example, the method of immersing $TiO(OH)_2$ fine particles in the solution containing the coupling agent and drying or the method of spraying the solution containing the coupling agent to $TiO(OH)_2$ fine particles and drying. The amount of the coupling agent to be adhered is preferably 0.1% by mass to 25% by mass relative to the $TiO(OH)_2$ fine particles. The specific gravity of the titanium compound is preferably 2.8 to 3.6.

Furthermore, one of other external additives may be a non-spherical amorphous silica particle. A major axis of the non-spherical amorphous silica particles is preferably 40 nm to 180 nm and more preferably 60 nm to 140 nm. When the major axis is less than 40 nm, due to the stress given in a developing device, an additive itself is embedded in the surface of the toner base particles, and can not sometimes exert an expected function. When it exceeds 180 nm, it becomes difficult to strongly adhere onto the surface of the toner base particles, and the silica particles are sometimes peeled from the surface of the toner base particles due to the stress given in the developing device.

Here, the major axis of the non-spherical amorphous silica particle can be measured by observing an optional single particle using an observation procedure such as SEM and TEM and processing its image.

The BET specific surface area of other external additives is preferably 10 $m^2/g$ to 300 $m^2/g$ and more preferably 20 $m^2/g$ to 300 $m^2/g$.

Here, the specific surface area can be calculated according to BET method using a specific surface area measurement apparatus ("Autosoap 1" manufactured by Yuasa Ionics) by adsorbing nitrogen gas to a sample surface and using a BET multipoint method.

An average particle diameter of other external additives is preferably 10 nm to 300 nm and more preferably 10 nm to 180 nm.

A amount of other external additive in the toner is preferably 0.1% by mass to 8.0% by mass and more preferably 0.2% by mass to 3.0% by mass.

[Method of Adding External Additives]

Here, the method of adding the organic silicone fine particle external additive of the present invention and other external additives to the surface of the toner base particles may be either a dry system adding treatment or a wet system adding treatment.

In the dry system adding treatment, the external additive and the toner base particles are mixed and the external additive is adhered to the surface of the toner base particles.

The mixture can be performed by a publicly known mixer such as a V type blender, HENSCHEL MIXER and a hybridizer.

A circumferential speed of a rotation body of these apparatuses is not particularly limited, can be appropriately selected depending on the purpose, and to disperse and immobilize onto the toner surface, it is preferable to rotate at a slightly slow speed of about 35 m/s followed by rotating at 35 m/s to 55 m/s.

The stirring is not particularly limited, can be appropriately selected depending on the purpose, and is preferably performed at 15° C. to 40° C.

In the wet system external addition, the external additive and the toner base particles are dispersed in a aqueous medium and the external additive is adhered to the toner particles.

In the wet system adding treatment, in the case of the dry toner, the toner base particles before dry system adding are dispersed in water using a surfactant if necessary. When the toner particles are formed in water, it is preferable to remove the surfactant used by washing and subsequently perform a wet system adding step. The excessive surfactant present in water is removed by solid liquid separation operation such as filtration and centrifugation, and a resulting cake or slurry is redispersed in the aqueous medium. Furthermore, inorganic particles are added and dispersed in the slurry. The inorganic particles can also be previously dispersed in the aqueous medium. At that time, if dispersed using the surfactant having a polarity opposed to a polarity of the surfactant used for making a water dispersion of the toner base particles, the external additive is efficiently adhered onto the toner particle surface. When the inorganic particles have been hydrophobilized and is hardly dispersed in a aqueous dispersion, the inorganic particles may be dispersed by using alcohol in a small amount in combination to reduce a surface tension and be easily wetted.

Subsequently, an aqueous solution of the surfactant having the opposed polarity is gradually added with stirring. It is preferable to use the surfactant having the opposed polarity at 0.01% by mass to 1% by mass relative to the toner particle solid content. The charge of the inorganic fine particle dispersion in water is neutralized by adding the surfactant having the opposed polarity, and the fine inorganic particles can be aggregated and adhered onto the toner particle surface. It is preferable to use this inorganic fine particle at 0.01% by mass to 5% by mass relative to the toner particle solid content. Instead of gradually adding the solution of the surfactant having the opposed polarity with stirring, the fine inorganic particles can be adhered by shifting pH of the dispersion to an acid side or an alkali side.

These fine inorganic particles adhered onto the toner surface can be immobilized on the toner surface to prevent the dissociation by subsequently heating the slurry. At that time, it is preferable to heat at a temperature higher than a glass transition temperature (Tg) of the resin which composes the toner. Furthermore, a heating treatment after drying may be performed with preventing the aggregation.

[Developer]

The developer of the present invention contains at least the toner of the present invention, and contains appropriately selected other components such as carriers. The developer may be a one-component developer or a two component developer. When used in a high speed printers accommodating the enhancement of data processing speeds in recent years, the two-component developer is preferable in terms of enhanced lifetime.

In the case of the one-component developer using the toner of the present invention, even when the toner is consumed and supplied, the variation of the toner particle diameters is small, and there is no filming of the toner to the developing roller and no fusion-bond of the toner to the member such as a blade for making the toner the thin layer. The good and stable developing properties and images are obtained in the long term use (stirring) of the developing device. In the case of the two-component developer using the toner of the present invention, even when the toner is consumed and supplied for a long time, the variation of the toner particle diameters during the development is small. The good and stable developing properties are obtained in the long term stirring in the developing device.

The carrier is not particularly limited, can be appropriately selected depending on the purpose, and those having a core material and a resin layer which covers the core material are preferable.

Materials for the core material are not particularly limited, can be appropriately selected from those known publicly, and for example, 50 emu/g to 90 emu/g of manganese-strontium (Mn—Sr) based materials and manganese-magnesium (Mn—Mg) based materials are preferable. In terms of assuring the image density, highly magnetized materials such as an iron powder (100 emu/g or more) and magnetite (75 emu/g to 120 emu/g) are preferable. In terms of being advantageous for making a high image quality because contact to the photoconductor on which the toner stands like ears can be weakened, weakly magnetized materials such as copper-zinc (Cu—Zn) based materials (30 emu/g to 80 emu/g) are also preferable. These may be used alone or in combination of two or more.

The particle diameter of the core material is preferably 10 μm to 150 μm and more preferably 40 μm to 100 μm in the volume average particle diameter.

When the average particle diameter (volume average particle diameter (D50)) is less than 10 μm, the fine powder is increased in the distribution of carrier particles, and magnetization per particle becomes low to sometimes cause carrier scattering. When it exceeds 150 μm, the specific surface area is reduced to sometimes cause toner scattering. In a full color printing where solid portions are abundant, reproducibility of the solid portions is sometimes degraded.

Materials of the resin layer is not particularly limited, can be appropriately selected from publicly known resins depending on the purpose, and includes, for example, amino based resins, polyvinyl based resins, polystyrene based resins, halogenated olefin resins, polyester based resins, polycarbonate based resins, polyethylene resins, polyvinyl fluoride resins, polyvinylidene fluoride resins, polytrifluoroethylene resins, polyhexafluoropropylene resins, copolymers of vinylidene fluoride and acryl monomer, copolymers of vinylidene fluoride and vinyl fluoride, fluoro terpolymers such as terpolymers of tetrafluoroethylene and vinylidene fluoride and non-fluoride monomer, and silicone resins. These may be used alone or in combination of two or more.

The amino based resins include, for example, urea-formaldehyde resins, melamine resins, benzoguanamine resins, urea resins, polyamide resins and epoxy resins. The polyvinyl based resins include, for example, acryl resins, polymethyl methacrylate resins, polyacrylonitrile resins, polyvinyl acetate resins, polyvinyl alcohol resins and polyvinyl butyral resins. The polystyrene based resins include, for example, polystyrene resins and styrene acryl copolymer resins. The halogenated olefin resins include, for example, polyvinyl chloride. The polyester based resins include, for example, polyethylene terephthalate resins and polybutylene terephthalate resins.

If necessary, conductive powders may be contained in the resin layer. The conductive powders include, for example, metal powders, carbon black, titanium oxide, tin oxide, and zinc oxide. The average particle diameter of these conductive powders is preferably 1 μm or less. When the average particle diameter exceeds 1 μm, it sometimes becomes difficult to control electric resistance.

The resin layer can be formed by dissolving the silicone resin in the solvent to prepare a coating solution, uniformly applying the coating solution on the surface of the core material by a publicly known application method, and drying followed by baking. The application method includes, for example, a dipping method, a spray method and a blush coating method.

The solvent is not particularly limited, can be appropriately selected depending on the purpose, and includes, for example, toluene, xylene, methylethylketone, methyl isobutyl ketone, cellsolve and butyl acetate.

The baking is not particularly limited, may be an external heating system or an internal heating system, and includes the methods using a fixed electric furnace, a fluidal electric furnace, a rotary electric furnace, and a burner furnace, and the method using microwave.

The amount of the resin layer in the carrier is preferably 0.01% by mass to 5.0% by mass. When the amount is less than 0.01% by mass, no uniform resin layer can be sometimes formed on the surface of the core material. When it exceeds 5.0% by mass, the resin layer becomes so thick that it causes the granulation of carrier particles one another, and no uniform carrier particles can be sometimes obtained.

When the developer is the two-component developer, the amount of the carrier in the two-component developer is not particularly limited, can be appropriately selected depending on the purpose, and for example, is preferably 90% by mass to 98% by mass and more preferably 93% by mass to 97% by mass.

The developer of the present invention contains the toner, therefore, combines the excellent cleaning ability, image quality and durability, and can stably form images with a high quality.

The developer of the present invention can be suitably used for the image formation by publicly known various electrographic methods such as magnetic one-component developing methods, non-magnetic one-component developing methods, and two-component developing methods, and particularly can be suitably used for the following process cartridge and image forming method of the present invention.

[Process Cartridge]

The process cartridge of the present invention has a photoconductor and a developing unit as an integrated unit, and further may include at least one image processing unit selected from a charging unit, a transferring unit, a cleaning unit and a charge eliminating unit, wherein the developing unit has the toner or the developer of the present invention in the process cartridge detachably mounted on the main body of the image forming apparatus.

The developing unit has at least a developer housing device which houses the toner or the developer of the present invention and a developer bearing member which bears and feeds the toner or the developer housed in the developer housing device, and further may have a layer thickness regulatory member for regulating a layer thickness of the toner to be borne.

The process cartridge of the present invention can be attached detachably to various electrographic apparatuses, and it is preferable to attach detachably to the image forming apparatus of the present invention described later.

Here, the process cartridge, for example, as shown in FIG. 1, builds-in the photoconductor 101, contains a charge unit 102, a developing unit 104, a transferring unit 108 and a cleaning unit 107, and further has the other members if necessary. In FIG. 1, 103 represents the exposure by the exposing unit, and a light source capable of writing at high resolution is used. In FIG. 1, 105 represents the recording medium. As the photoconductor 101, the same one as in the image forming apparatus described later can be used. An optional charging member is used for the charging unit 102.

Subsequently, in the image formation process by the process cartridge shown in FIG. 1, as the photoconductor 101 rotates in an arrow direction, the latent electrostatic image corresponding to an exposure image is formed on its surface by charge by the charging unit 102 and the exposure 103 by the exposing unit (not shown in the figure). This latent electrostatic image is developed with the toner in the developer of the present invention in the developing unit 104, the toner image is transferred onto the recording medium 105 by the transferring unit 108 and printed out. Subsequently, the photoconductor surface after the transfer of the image is cleaned by the cleaning unit 107, and its electricity is removed by the charge eliminating unit (not shown in the figure). The above operation is repeated again.

[Image Forming Method and Image Forming Apparatus]

The image forming method of the present invention includes at least a latent electrostatic image forming step, a developing step, a transferring step, and a fixing step, preferably includes a cleaning step, and further includes other steps appropriately selected as needed such as an electricity removing step, a recycling step and a controlling step.

The image forming apparatus of the present invention has at least a latent electrostatic image bearing member, a latent electrostatic image forming unit, a developing unit, a transferring unit, and a fixing unit, preferably has a cleaning unit, and further has other units appropriately selected as needed such as a charge eliminating unit, a recycling unit, and a controlling unit.

The image forming method of the present invention can be suitably carried out by the image forming apparatus of the present invention, the latent electrostatic image forming step can be performed by the latent electrostatic image forming unit, the developing step can be performed by the developing unit, the transferring step can be performed by the transferring unit, the fixing step can be performed by the fixing unit, and the other step can be performed by the other unit.

[Latent Electrostatic Image Forming Step and Latent Electrostatic Image Forming Unit]

The latent electrostatic image forming step is a step of forming the latent electrostatic image on the latent electrostatic image bearing member.

In the latent electrostatic image bearing member (sometimes referred to as a "light conductive insulator" or a "photoconductor"), its material, shape, structure, and size are not particularly limited, and can be appropriately selected from those known publicly. Its shape suitably includes a drum shape, and its material includes inorganic photoconductors such as amorphous silicon and serene and organic photoconductors such as polysilane and phthalopolymethine. Among them, amorphous silicon is preferable in terms of long lifetime.

The latent electrostatic image can be formed, for example, by evenly charging the surface of the photoconductor (the latent electrostatic image bearing member) and subsequently exposing like the image, and can be formed by the latent electrostatic image forming unit. The latent electrostatic image forming unit is, for example, equipped with at least a charging device which evenly charges the surface of the latent electrostatic image bearing member and an exposing device which exposes the surface of the latent electrostatic image bearing member like the image.

The charging can be performed, for example using the charging device by applying voltage onto the surface of the latent electrostatic image bearing member.

The charging device is not particularly limited, can be appropriately selected depending on the purpose, and includes, for example, a publicly known contact charging device equipped with a conductive or semi-conductive roll, brush, film, or rubber blade, and a non-contact charging device utilizing corona discharge, e.g., a corotron and scorotron.

The exposure, for example, can be performed by exposing the surface of the latent electrostatic image bearing member like the image using the exposing device.

The exposing device is not particularly limited as long as the exposure can be performed like the image to be formed on the surface of the latent electrostatic image bearing member charged by the charging device, can be appropriately selected depending on the purpose, and includes, for example, various exposing devices, e.g., a copy optical system, a rod lens array system, a laser optical system, and a liquid crystal shutter optical system.

A light backside method of exposing from the backside of the latent electrostatic image bearing member may be employed in the present invention.

The developing step is a step of forming the visible image by developing the latent electrostatic image using the toner or the developer of the present invention.

The visible image can be formed, for example, by developing the latent electrostatic image using the toner or the developer of the present invention, and can be formed by the developing unit.

The developing unit is not particularly limited as long as the development can be performed using the toner or the developer of the present invention, can be appropriately selected from those known publicly, and suitably includes those having at least a developing device which houses the toner or the developer of the present invention and can impart the toner or the developer to the latent electrostatic image in contact or in no contact with it. The developing device equipped with the vessel containing the toner of the present invention is more preferable.

The developing device may employ a dry developing system or a wet developing system, or may be a monochromatic developing device or a multicolor developing device. For example, one having a stirring device which charges by frictionizing and stirring the toner or the developer and a rotatable magnet roller are suitably included.

In the developing device, for example, the toner and the carrier are mixed and stirred, the toner is charged by friction at that time and kept in the ear-standing state on the surface of the rotating magnet roller to form a magnetic brush. The magnet roller is disposed in the vicinity of the latent electrostatic image bearing member (photoconductor). Thus, a part of the toner which composes the magnetic brush formed on the surface of the magnet roller migrates to the surface of the latent electrostatic image bearing member (photoconductor) by an electrically attracting force. As a result, the latent electrostatic image is developed by the toner and the visible image is formed on the surface of the latent electrostatic image bearing member (photoconductor) by the toner.

The developer housed in the developing device is a developer containing the toner of the present invention, and the developer may be a one-component developer or a two-component developer. The toner contained in the developer is the toner of the present invention.

The transferring step is a step of transferring the visible image onto a recording medium. It is preferable that using an intermediate transferring member, the visible image is primarily transferred onto the intermediate transferring member and subsequently the visible image is secondarily transferred onto the recording medium. Using as the toner, the toner having two or more colors and preferably full color toner, it is more preferable to have a primary transferring step in which the visible image is transferred onto the intermediate transferring member to form a composite transfer image and a secondary transferring step in which the composite transfer image is transferred onto the recording medium.

The transfer can be performed by charging the visible image from the latent electrostatic image bearing member (photoconductor) using a transfer charging device, and can be performed by the transferring unit. A preferable aspect is that the transferring unit has a primary transferring unit in which the visible image is transferred onto the intermediate transferring member to form the composite transfer image and a secondary transferring unit in which the composite transfer image is transferred onto the recording medium.

The intermediate transferring member is not particularly limited, can be appropriately selected from those known publicly depending on the purpose, and suitably includes, for example, a transfer belt.

It is preferable that the transferring unit (the primary transferring unit, the secondary transferring unit) has a transferring device which peels and charges the visible image formed on the latent electrostatic image bearing member (photoconductor) to the side of the recording medium. There may be one transferring unit or multiple transferring units. The transferring device includes a corona transferring device by corona discharge, the transfer belt, a transfer roller, a pressure transfer roller, and an adhesion transferring device. The recording medium is not particularly limited, and can be appropriately selected from the recording media (recording papers) known publicly.

The fixing step is a step of fixing the visible image transferred onto the recording medium using the fixing unit. Each color toner may be fixed every transfer onto the recording medium, or respective toners may be laminated and then fixed all at once.

The fixing unit is not particularly limited, can be appropriately selected depending on the purpose, and heating pressurizing units known publicly are suitable. The heating pressurizing units include the combination of a heating roller and a pressurizing roller and the combination of the heating roller, the pressurizing roller, and an endless belt.

The heating in the heating pressurizing unit is preferably to be at 80° C. to 200° C. typically.

In the present invention, depending on the purpose, together with or in place of the fixing step and the fixing unit, a light fixing device known publicly, for example, may be used.

The electricity removing step is a step of removing the electricity by applying an electricity removing bias to the latent electrostatic image bearing member, and can be suitably performed by the charge eliminating unit.

The charge eliminating unit is not particularly limited, may be able to apply the electricity removing bias to the latent electrostatic image bearing member, can be appropriately selected from electricity removing devices known publicly, and suitably includes, for example, an charge eliminating lamp.

The cleaning step is a step of removing the toner for electrographs left on the latent electrostatic image bearing member, and can be suitably performed using the cleaning unit.

The cleaning unit is not particularly limited, may be able to remove the toner for electrographs left on the latent electrostatic image bearing member, can be appropriately selected from publicly known cleaners, and suitably includes, for example, a magnetic brush cleaner, an electrostatic brush cleaner, a magnetic roller cleaner, a blade cleaner, a brush cleaner, and a web cleaner.

The recycling step is a step of recycling the toner removed in the cleaning step in the developing unit, and can be suitably performed using the recycling unit.

The recycling unit is not particularly limited, and includes publicly known feeding units.

The controlling step is a step of controlling respective steps, and can be suitably performed using the controlling unit.

The controlling unit is not particularly limited as long as it can control the operation of each unit, can be appropriately selected depending on the purpose, and includes, for example, equipments such as sequencers and computers.

[Image Forming Apparatus Example 1]

One example of the image forming apparatus appropriate for performing the image forming method of the present invention will be described with reference to FIG. 2. The image forming apparatus 100 shown in FIG. 2 is equipped with a photoconductor drum 10 (hereinafter sometimes referred to as the "photoconductor 10") as the latent electrostatic image bearing member, a charging roller 20 as the charging unit, an exposer 30 as the exposing unit, a developing device 40 as the developing unit, an intermediate transferring member 50, a cleaning device 60 as the cleaning unit having a cleaning blade, and an charge eliminating lamp 70 as the charge eliminating unit.

The intermediate transferring member 50 is an endless belt, and is tightly stretched with three rollers 51 disposed in the endless belt so as to move in an arrow direction. A part of three rollers 51 also functions as a transfer bias roller which can apply a given transfer bias (primary transfer bias) to the intermediate transferring member 50. The cleaning device 90 having the cleaning blade is disposed in the vicinity of the intermediate transferring member 50. A transferring roller 80 is oppositely disposed as the transferring unit which can apply the transfer bias to transfer (secondary transfer) a developed image (toner image) onto a transfer paper 95 as a final transfer material. In a surrounding area of the intermediate transferring member 50, the corona charging device 58 for imparting the charge to the toner image on the intermediate transferring member 50 is disposed in a rotation direction of the intermediate transferring member 50, between a contact section of the photoconductor 10 with the intermediate transferring member 50 and a contact section of the intermediate transferring member 50 with a transfer paper 95.

The developing device 40 is composed of a developing belt 41 as the developer bearing member and a black developing unit 45K, a yellow developing unit 45Y, a magenta developing unit 45M and a cyan developing unit 45C arranged together around the developing belt 41. The black developing unit 45K is equipped with a developer housing section 42K, a developer supplying roller 43K, and a developing roller 44K, the yellow developing unit 45Y is equipped with a developer housing section 42Y, a developer supplying roller 43Y, and a developing roller 44Y, the magenta developing unit 45M is equipped with a developer housing section 42M, a developer supplying roller 43M, and a developing roller 44M, and the cyan developing unit 45C is equipped with a developer housing section 42C, a developer supplying roller 43C, and a developing roller 44C. The developing belt 41 is an endless belt and tightly stretched with multiple belt rollers rotatably, and a part thereof is contacted with the photoconductor 10.

Figure 2:
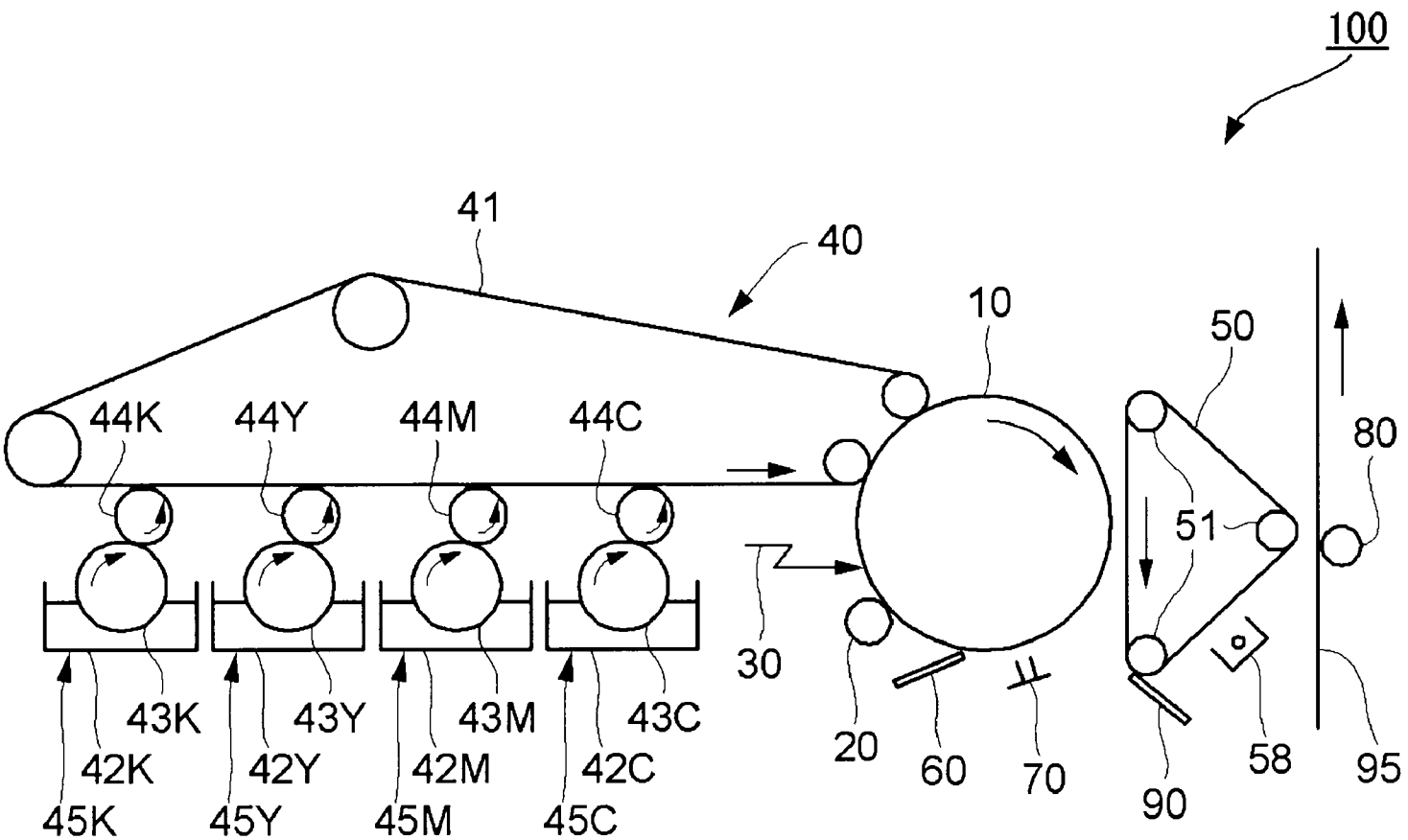
FIG. 2 illustrates an example of an image forming apparatus used in the present invention.

In the image forming apparatus 100 shown in FIG. 2, for example, the charging roller 20 charges the photoconductor drum 10 evenly. The photoconductor drum 10 is exposed using the exposer 30 to form the latent electrostatic image. The latent electrostatic image formed on the photoconductor drum 10 is developed by supplying the toner from the developing device 40 to form the visible image (toner image). The visible image (toner image) is transferred onto the intermediate transferring member 50 (primary transfer) by voltage applied from the roller 51, and further transferred onto the transfer paper 95 (secondary transfer). As a result, the transfer image is formed on the transfer paper 95. The toner remaining on the photoconductor 10 is removed by the cleaning device 60, and the charge on the photoconductor 10 is once removed by the charge eliminating lamp 70.

In the image forming apparatus and the image forming method of the present invention, a high image quality is efficiently obtained, because they use the toner of the present invention which combines an excellent cleaning ability, image quality, and durability.

[Image Forming Apparatus Example 2]

Figure 3:
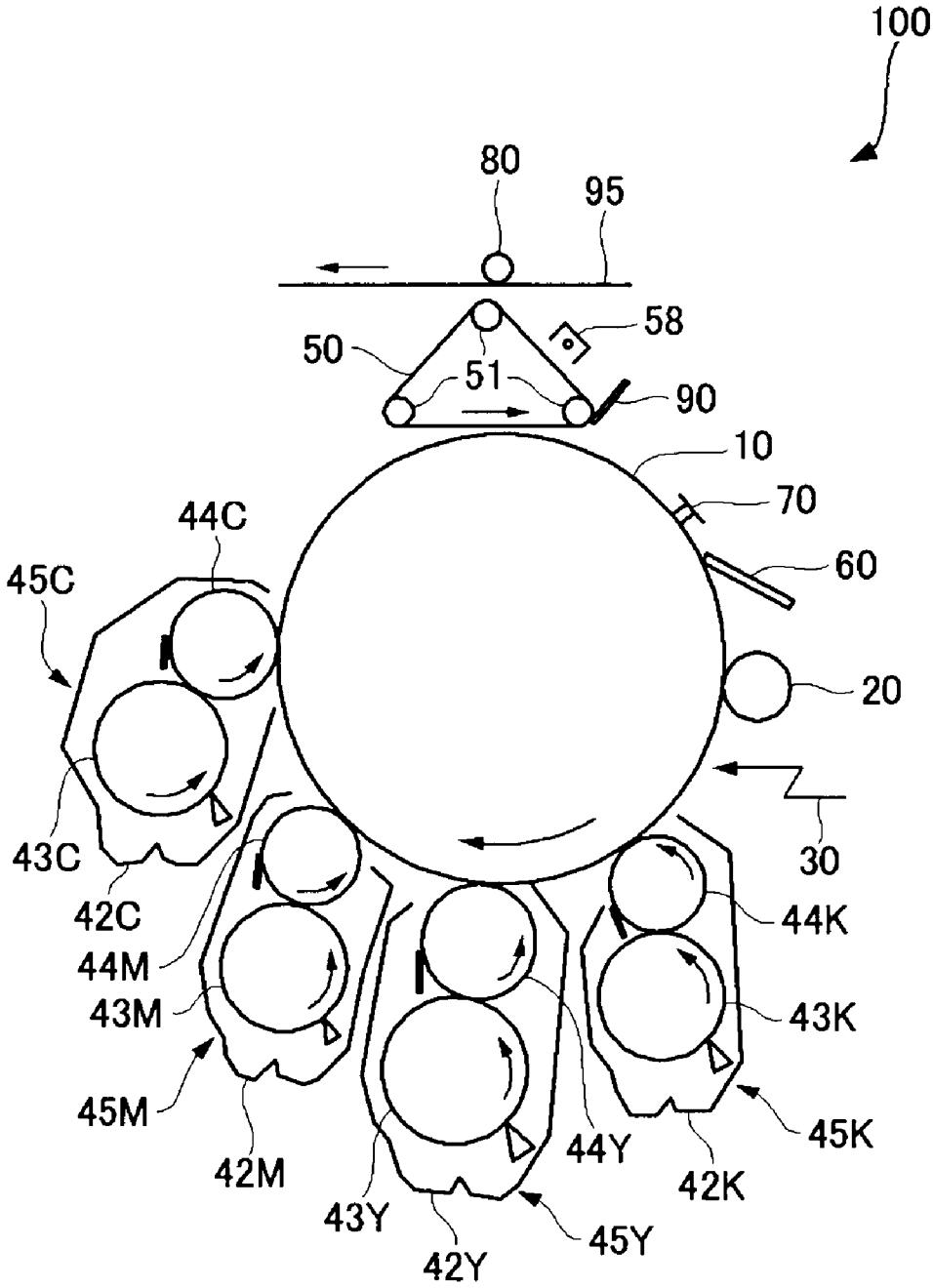
FIG. 3 illustrates another example of an image forming apparatus used in the present invention.

Another aspect of performing the image forming method of the present invention will be described with reference to FIG. 3. The image forming apparatus shown in FIG. 3 has the same constitution and exhibits the same action effects as in the image forming apparatus 100 shown in FIG. 2, except that instead of including the developing device 40 in the image forming apparatus shown in FIG. 2 the image forming apparatus shown in FIG. 3 is directly oppositely disposing the black developing unit 45K, the yellow developing unit 45Y, the magenta developing unit 45M, and the cyan developing unit 45C around the photoconductor 10. In FIG. 3 and also in FIG. 4 described below, those constituents which were the same as the constituents of the image forming apparatus shown in FIG. 2 were represented by the same signs and their description are omitted.

[Image Forming Apparatus Example 3]

Figure 4:
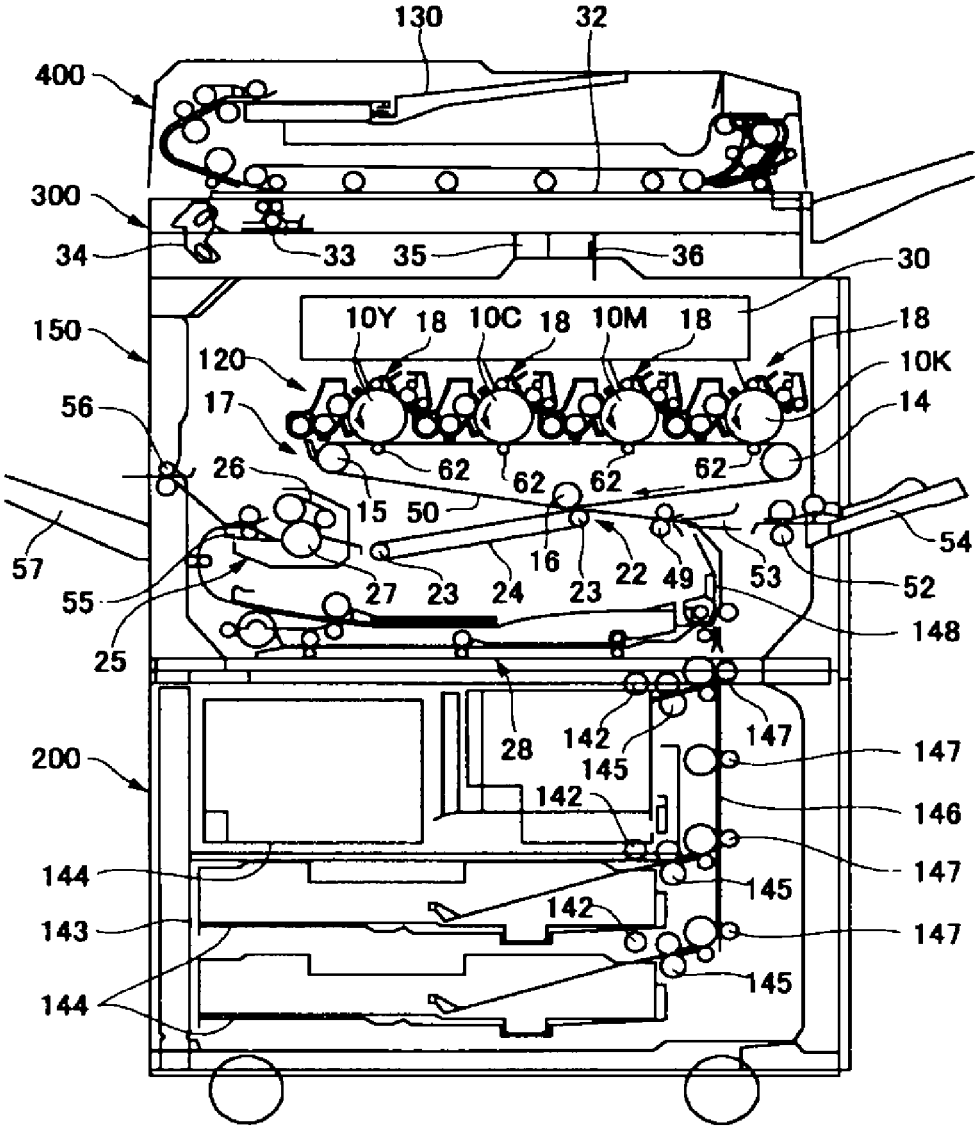
FIG. 4 illustrates still another example of an image forming apparatus used in the present invention.

Another aspect of performing the image forming method of the present invention will be described with reference to FIG. 4. An image forming apparatus shown in FIG. 4 is a tandem type color image forming apparatus. The image forming apparatus is equipped with a copy apparatus main body 150, a paper supply table 200, a scanner 300, and an automatic draft feeding (ADF) apparatus 400.

In the copy apparatus main body 150, an endless belt-shaped intermediate transferring member 50 is provided in a central section. And, the intermediate transferring member 50 is tightly stretched with support rollers 14, 15 and 16 and is rotatable clockwise. A cleaning device 17 to remove the residual toner remaining on the intermediate transferring member 50 is disposed in the vicinity of the support roller 15. An image forming unit 120 in which 4 image forming components 18 of yellow, cyan, magenta, and black have been oppositely arranged together is disposed to the intermediate transferring member 50 tightly stretched with the support rollers 14 and 15, along a feeding direction thereof. In the vicinity of the image forming unit 120, the exposer 30 is disposed. A secondary transferring apparatus 22 is disposed at the side of the intermediate transferring member 50 opposite to the side at which the image forming unit 120 is disposed. In the secondary transferring apparatus 22, a secondary transfer belt 24 which is the endless belt is tightly stretched with a pair of support rollers 23, and the recording paper fed on the secondary transfer belt 24 can be mutually contacted with the intermediate transferring member 50. In the vicinity of the secondary transferring apparatus 22, the fixing apparatus 25 is disposed. The fixing apparatus 25 is equipped with a fixing belt 26 which is an endless belt and a pressurizing roller 27 disposed by press-pushing by the fixing belt 26.

In the vicinity of the secondary transferring apparatus 22 and the fixing apparatus 25, a sheet reversing apparatus 28 which reverses the recording paper to form the images on both sides of the recording paper is disposed.

Next, the formation of the full color image (color copy) using the image forming unit 120 will be described. First, a draft is set on a draft table 130 of the automatic draft feeding apparatus (ADF) 400, or alternatively the automatic draft feeding apparatus 400 is opened, the draft is set on a contact glass 32 of the scanner 300 and the automatic draft feeding apparatus 400 is closed.

When a start switch (not shown in the figure) is pressed, after feeding the draft onto the contact glass 32 when the draft has been set in the automatic draft feeding apparatus 400, or immediately when the draft has been set on the contact glass 32, the scanner is driven, and a first carriage 33 and a second carriage 34 run. At that time, the light from the light source is irradiated as well as the reflection light from a draft side irradiated from the first carriage is reflected at a mirror in the second carriage 34, and received by a reading sensor 36 through an imaging lens 35. By this operation, a draft is read out to generate image information of respective colors of black, yellow, magenta, and cyan. Each image information is then transmitted to respective image forming components 18 in the image forming unit 120 to form the visible images of respective colors of black, yellow, magenta, and cyan in each image forming component.

EXAMPLES

The present invention will be further described in detail below with reference to Examples. However, embodiments of the present invention are not limited to the disclosed ones. Note that "parts" and % indicate "parts by weight" and "% by weight", respectively.

[Preparation of Developer]

First, a toner, a carrier, and a two-component developer composed of the toner and carrier used in the Examples will be described.

Toners used in the Example were prepared by the method described below.

—Synthesis of Organic Fine Particle Emulsion—

Into a reaction vessel equipped with a stirring bar and a thermometer, 683 parts of water, 11 parts of sodium salt of methacrylic acid ethylene oxide adduct sulfate ester (ELEMINOL RS-30 manufactured by Sanyo Chemical Industries, Ltd.), 83 parts of styrene, 83 parts of methacrylic acid, 110 parts of butyl acrylate and 1 part of ammonium persulfate were added, and the mixture was stirred at 400 rpm for 15 minutes to yield a white liquid emulsion. The temperature of the reaction system was raised up to 75° C. by heating, and the reaction was performed for 5 hours. Then, 30 parts of an aqueous solution of 1% ammonium persulfate was added, and the reaction system was matured at 75° C. for 5 hours to yield an aqueous dispersion of vinyl based resin (copolymer of sodium salt of styrene-methacrylic acid-butyl acrylate-methacrylic acid ethylene oxide adduct sulfate ester) [fine particle dispersion 1].

The weight average particle diameter of the resulting [fine particle dispersion 1] measured by LA-920 was 105 nm. A part of the [fine particle dispersion 1] was dried to isolate a resin component. The glass transition temperature of the resin component was 59° C., and the weight average molecular weight was 150,000.

—Preparation of Aqueous Phase—

Water (990 parts), 83 parts of [fine particle dispersion 1], 37 parts of an aqueous solution of 48.5% sodium dodecyldiphenyl ether disulfonate (ELEMINOL MON-7 manufactured by Sanyo Chemical Industries, Ltd.), and 90 parts of ethyl acetate were mixed and stirred to yield a milky white liquid. This was called as [aqueous phase 1].

—Synthesis of Low Molecular Polyester—

In a reaction vessel equipped with a condenser tube, a stirrer and a nitrogen inlet tube, 229 parts of bisphenol A ethylene oxide 2 mol adduct, 529 parts of bisphenol A propylene oxide 3 mol adduct, 208 parts of terephthalic acid, 46 parts of adipic acid and 2 parts of dibutyltin oxide were added, and reacted under atmospheric pressure at 230° C. for 8 hours. The reaction was performed under reduced pressure of 10 mmHg to 15 mmHg for 5 hours. Then, 44 parts of trimellitic acid anhydrate were added into the reaction vessel, and the reaction was continued at 180° C. under atmospheric pressure for 2 hours to yield [low molecular polyester 1].

The resulting [low molecular polyester 1] had a number average molecular weight of 2,500, a weight average molecular weight of 6,700, a Tg of 43° C. and an acid value of 25.

—Synthesis of Intermediate Polyester and Prepolymer—

In a reaction vessel equipped with a condenser tube, a stirrer and a nitrogen inlet tube, 682 parts of bisphenol A ethylene oxide 2 mol adduct, 81 parts of bisphenol A propylene oxide 2 mol adduct, 283 parts of terephthalic acid, 22 parts of trimellitic acid anhydrate and 2 parts of dibutyltin oxide were added, and reacted under atmospheric pressure at 230° C. for 8 hours. Then, the reaction was performed under reduced pressure of 10 mmHg to 15 mmHg for 5 hours to yield [intermediate polyester 1]. The resulting [intermediate polyester 1] had a number average molecular weight of 2,100, a weight average molecular weight of 9,500, a Tg of 55° C., an acid value of 0.5 and a hydroxyl group value of 51.

Subsequently, in a reaction vessel equipped with a condenser tube, a stirrer and a nitrogen inlet tube, 410 parts of the [intermediate polyester 1], 89 parts of isophorone diisocyanate and 500 parts of ethyl acetate were placed, and reacted at 100° C. for 5 hours to yield [prepolymer 1]. The free isocyanate content of the [prepolymer 1] was 1.53%.

—Synthesis of Ketimine—

In a reaction vessel equipped with a stirring bar and a thermometer, 170 parts of isophorone diamine and 75 parts of methylethylketone were added, and reacted at 50° C. for 5 hours to yield a [ketimine compound 1]. The amine value of the resulting [ketimine compound 1] was 418.

—Synthesis of Master Batch—

Water (35 parts), 40 parts of phthalocyanine a pigment (FG7351 manufactured by Toyo Ink Mfg. Co., Ltd.) and 60 parts of polyester resin (RS801 manufactured by Sanyo Chemical Industries, Ltd.) were mixed using HENSCHEL MIXER (manufactured by Mitsui Mining Co., Ltd.), the resulting mixture was kneaded at 150° C. for 30 minutes using two rolls, subsequently pressure rolled and cooled, and then pulverized by a pulverizer to yield [master batch 1].

—Preparation of Oil Phase—

In a reaction vessel equipped with a stirring bar and a thermometer, 378 parts of the [low molecular polyester 1], 110 parts of carnauba wax, 22 parts of CCA (salicylate metal complex E-84 manufactured by Orient Chemical Industries Ltd.) and 947 parts of ethyl acetate were added, the temperature was raised to 80° C. under stirring, and the temperature was kept for 5 hours, and then cooled to 30° C. in one hour. Then, 500 parts of the [master batch 1] and 500 parts of ethyl acetate were placed in the vessel, and mixed for one hour to yield [raw material solution 1].

The resulting [raw material solution 1] (1,324 parts) was transferred to another vessel, and using a bead mill (ULTRAVISCOMILL manufactured by Imex), carbon black and wax were dispersed under conditions of a liquid sending speed of 1 kg/hr, a disc circumferential speed of 6 m/second, filled with 80% by volume of 0.5 mm zirconium beads and 3 passes. Subsequently, 1,324 parts of a 65% ethyl acetate solution of [low molecular polyester 1] was added, and the reaction system was dispersed once using the bead mill under the above conditions to yield [pigment-wax dispersion 1]. The solid content concentration (130° C., 30 minutes) of the resulting [pigment-wax dispersion 1] was 50%.

—Emulsification—

In a vessel, 648 parts of the [pigment-wax dispersion 1], 154 parts of the [prepolymer 1] and 6.6 parts of the [ketimine compound 1] were poured, and mixed at 5,000 rpm for one minutes using T.K. HOMOMIXER (manufactured by Tokushu Kika Kogyo Co., Ltd.). Then, 1,200 parts of the [aqueous phase 1] was added to the vessel, the mixture was mixed at 13,000 rpm for 20 minutes using T.K. HOMOMIXER to yield [emulsified slurry 1].

—Shape Control—

Appropriate amounts of ion-exchange water, an activating agent, and a thickener were poured in a vessel and stirred. Into this aqueous solution, the [emulsified slurry 1] was added, and the components were mixed at 2,000 rpm for one hour using T.K. HOMOMIXER (manufactured by Tokushu Kika Kogyo Co., Ltd.) to yield [shape controlled slurry 1].

—Desolvation—

In a vessel equipped with a stirrer and a thermometer, the [shape controlled slurry 1] was poured, the [shape control slurry 1] was subjected to a desolvation treatment at 30° C. for 8 hours, and the matured at 45° C. for 4 hours to yield [dispersion slurry 1].

—Washing and Drying—

The [dispersion slurry 1] (100 parts) was filtrated under reduced pressure, and subsequently washed and dried as follows.

(1) Ion exchange water (100 parts) was added to a filter cake, which was then mixed using T.K. HOMOMIXER (12,000 rpm for 10 minutes) and subsequently filtrated.

(2) An aqueous solution (100 parts) of 10% sodium hydroxide was added to the filter cake of (1), which was then mixed using T.K. HOMOMIXER (12,000 rpm for 30 minutes) and subsequently filtrated under reduced pressure.

(3) Ten percent by weight hydrochloric acid (100 parts) was added to the filter cake of (2), which was then mixed using T.K. HOMOMIXER (12,000 rpm for 10 minutes) and subsequently filtrated.

(4) Ion exchange water (300 parts) was added to the filter cake of (3), which was then mixed using T.K. HOMOMIXER (12,000 rpm for 10 minutes) and subsequently filtrated. The filtration of (4) was repeated twice to yield [filter cake 1].

The [filter cake 1] thus obtained was dried at 45° C. for 48 hr using an air circulating drier, and sieved through a 75 μm-mesh screen to thereby yield final [toner base particle A].

The carrier used in the following Examples and Comparative Examples was prepared as follows. First, 200 parts of a silicone resin solution (manufactured by Shin-Etsu Chemical Co., Ltd.) and 3 parts of carbon black (manufactured by Cabot) were dissolved and dispersed to obtain a coating solution. Then, the coating solution was applied over the surface of 2500 parts of a ferrite core material by a fluidized-bed spray method to coat the core material surface, and then the core material coated with the coating solution was baked in an electric furnace at 300° C. for 2 hours to yield a silicon resin-coated carrier. For the carrier particle diameter, it is preferable to use a carrier having a relatively sharp particle diameter distribution and an average particle diameter of 30 μm to 60 μm. Such a carrier was used in the following Example and Comparative Examples.

Example 1

Synthesis of Fine Organic Silicone Particle A

Ion-exchange water (400 g) was poured into a reaction vessel and 0.2 g of a 48% aqueous solution of sodium hydroxide was added. Into this aqueous solution, 47 g of methyl trimethoxy silane and 48 g of tetraethoxy silane were added and a hydrolysis reaction of them was performed for an hour with the reaction temperature kept at 13° C. to 15° C. Then, 1.8 g of a 10% aqueous solution of sodium dodecylbenzensulfonate was further added and a hydrolysis reaction was performed for 3 hours at the same temperature to yield a transparent reactant containing a silanol compound in a total of 4 hours. Then, the reactant thus obtained was subjected to a condensation reaction for 5 hours with the reaction temperature kept at 30° C. to 80° C. to yield an aqueous suspension containing a fine organic silicone particle. This aqueous suspension was filtered through a membrane filter, the filtrate was subjected to centrifugation to isolate white fine particles. The white fine particles thus isolated were washed with water and subjected to a hot-air drying at 150° C. for 5 hours to yield 30 g of a fine organic silicone particle A.

The organic silicone fine particle A was observed by a scanning electron microscope and found that this fine organic silicone particle A had a hollow hemispherical body, was an organic silicone fine particle having an average diameter of 1.43 μm in a cross-section of the spherical surface, and was composed of a polysiloxane cross-linked structure with a molar ratio of the siloxane unit represented by Formula 1 to the siloxane unit represented by Formula 2 of 40/60 determined by elemental analysis, ICP emission spectroscopic analysis, and FT-IR spectroscopy analysis.

With respect to the particles thus obtained, the average particle diameter (μm) was measured using COULTER MULTISIZER II (manufactured by COULTER COMPANY LIMITED) and a diameter calculated based on a weight distribution was adopted. Into the toner base particles A, 1.0% of this hemispheric organic fine particles A was added and mixed using a HENSCHEL MIXER at a circumferential speed of stirring blades of 20 m/s, and then, into this mixture, 0.8 parts of isobutyl-treated hydrophobic titanium oxide having an average diameter of 15 nm and 1.0 part of hexamethyldisilazane-treated hydrophobic silica having an average particle diameter of 12 nm were added and mixed using a HENSCHEL MIXER at a circumferential speed of stirring blades of 20 m/s to obtain toner A.

Example 2

Following a procedure similar to Example 1, 400 g of ion-exchange water was poured into a reaction vessel, 0.35 g of a 48% aqueous solution of sodium hydroxide and 0.15 g of a 20% aqueous solution of α-(p-nonylphenyl)-ω-hydroxy (polyoxyethylene) (number of oxyethylene units=10) were added, and the resultant solution was stirred sufficiently to produce a homogenous solution. With the temperature of this aqueous solution kept at 14° C., into this aqueous solution, a monomer mixture of 31 g of methyl trimethoxy silane, 28.4 g of 3-metacryloxypropyl trimethoxy silane, and 47.5 g of tetraethoxy silane was gradually delivered by drops so as not to mix the aqueous solution and the monomer layer, after completion of the dropping, the aqueous solution and the monomer layer were slowly stirred in a laminar flow state maintaining both layers. After one hour, 1.7 g of a 10% aqueous solution of sodium dodecylbenzensulfonate was added and stirred slowly as before further for 3 hours at 14° C. Then the reactant thus obtained was further subjected to a condensation reaction for 5 hours at 30° C. to 80° C. to yield an aqueous suspension containing a fine organic silicone particle. This aqueous suspension was filtered through a membrane filter, the filtrate was subjected to centrifugation to isolate white fine particles. The white fine particles thus isolated were washed with water and subjected to hot-air drying at 150° C. for 5 hours to yield 35 g of fine organic silicone particle B.

The measurement and analysis similar to Example 1 revealed that this fine organic silicone particle B had a hollow hemispherical body, was an organic silicone fine particle having an average diameter of 0.9 μm in a cross-section of the spherical surface, and was composed of a polysiloxane cross-linked structure with a molar ratio of the siloxane unit represented by Formula 1 to the siloxane unit represented by Formula 2 of 40/60.

With respect to the particle thus obtained, the average particle diameter (μm) was measured using COULTER MULTISIZER II (manufactured by COULTER COMPANY LIMITED) and a diameter calculated based on a weight distribution was adopted. Into the toner base particle A, 1.0% of this hemispheric organic fine particles B was added and mixed using a HENSCHEL MIXER at a circumferential speed of stirring blades of 20 m/s, and then, into this mixture, 0.8 parts of isobutyl-treated hydrophobic titanium oxide having an average particle diameter of 15 nm and 1.0 part of hexamethyldisilazane-treated hydrophobic silica having an average particle diameter of 12 nm were added and mixed using a HENSCHEL MIXER at a circumferential speed of stirring blades of 20 m/s to obtain toner B.

Example 3

Following a procedure similar to Example 1, 400 g of an ion-exchange water was poured into a reaction vessel, 0.34 g of a 48% aqueous solution of sodium hydroxide and 0.17 g of a 20% aqueous solution of α-(p-nonylphenyl)-ω-hydroxy (polyoxyethylene) (the number of oxyethylene units=10) was added, and the resultant solution was stirred sufficiently to produce a homogenous solution. With the temperature of this solution kept at 14° C., into this solution, a monomer mixture of 32 g of methyl trimethoxy silane, 28.4 g of 3-metacryloxypropyl trimethoxy silane, and 47.5 g of tetraethoxy silane was gradually delivered by drops so as not to mix the solution and the monomer layer, after completion of the dropping, the solution and the monomer layer were slowly stirred and hydrolyzed for three hours in a laminar flow state maintaining both layers. Then the temperature of the reaction system was raised to 30° C. to 80° C., the resultant mixture was subjected to a condensation reaction for five hours to obtain an aqueous suspension containing an organic silicone fine particle. From this aqueous suspension, a white fine particle was separated by a centrifugal machine. The white fine particle thus separated was washed, and dried in a hot air at 150° C. for five hours to obtain 60 g of fine organic silicone particle C.

The measurement and analysis similar to Example 1 revealed that this fine organic silicone particle C had a hollow hemispherical body, was an organic silicone particle having an average diameter of 0.6 μm in a cross-section of the spherical surface, and was composed of a polysiloxane cross-linked structure with a molar ratio of the siloxane unit represented by Formula 1 to the siloxane unit represented by Formula 2 of 40/60.

With respect to the particle thus obtained, the average particle diameter (μm) was measured using COULTER MULTISIZER II (manufactured by COULTER COMPANY LIMITED) and a diameter calculated based on a weight distribution was adopted. Into the toner base particle A, 1.0% of this hemispheric organic fine particle C was added and mixed using a HENSCHEL MIXER at a circumferential speed of stirring blades of 20 m/s, and then, into this mixture, 0.8 parts of isobutyl-treated hydrophobic titanium oxide having an average diameter of 15 nm and 1.0 part of hexamethyldisilazane-treated hydrophobic silica having an average diameter of 12 nm were added and mixed using a HENSCHEL MIXER at a circumferential speed of stirring blades of 20 m/s to obtain toner C.

Example 4

Into a reaction vessel, 400 g of an ion-exchange water was poured and 0.35 g of a 48% aqueous solution of sodium hydroxide was added, and an aqueous solution was thus obtained. Into this aqueous solution, 47 g of methyl trimethoxy silane and 47.5 g of tetraethoxy silane were added and subjected to a hydrolysis reaction for four hours keeping the temperature at 13° C. to 15° C. to obtain a transparent reactant containing a silanol compound. Then, this reactant was subjected to a condensation reaction for five hours with the reactant temperature kept at 30° C. to 80° C. to obtain an aqueous suspension containing an organic silicone fine particle. This aqueous suspension was filtered through a membrane filter, then, the filtrate was subjected to a centrifugation to separate a white fine particle. The white fine particle thus separated was washed and dried in a hot air at 150° C. for five hours to obtain 55 g of fine organic silicone particle D.

The measurement and analysis similar to Example 1 revealed that this fine organic silicone particle D had a hollow hemispherical body, was an organic silicone fine particle having an average diameter of 6.0 μm in a cross-section of the spherical surface, and was composed of a polysiloxane cross-linked structure with a molar ratio of the siloxane unit represented by Formula 1 to the siloxane unit represented by Formula 2 of 40/60.

With respect to the particle thus obtained, the average particle diameter (μm) was measured using COULTER MULTISIZER II (manufactured by COULTER COMPANY LIMITED) and a diameter calculated based on a weight distribution was adopted. Into the toner base particle A, 1.0% of this hemispheric organic fine particle D was added and mixed using a HENSCHEL MIXER at a circumferential speed of stirring blades of 20 m/s, and then, into this mixture, 0.8 parts of isobutyl-treated hydrophobic titanium oxide having an average diameter of 15 nm and 1.0 part of hexamethyldisilazane-treated hydrophobic silica having an average diameter of 12 nm were added and mixed using a HENSCHEL MIXER at a circumferential speed of 20 m/s to obtain toner D.

Comparative Example 1

Into the toner base particle A, 1.0% of non-cross-linked monodispersion particle (MP-300 (a trade name) manufactured by Soken Chemical & Engineering Co., Ltd.) having an average particle diameter of 0.1 μm was added and mixed using a HENSCHEL MIXER at a circumferential speed of 20 m/s of stirring blades, and then, into this mixture, 0.8 parts of isobutyl-treated hydrophobic titanium oxide having an average particle diameter of 15 nm and 1.0 part of hexamethyldisilazane-treated hydrophobic silica having an average particle diameter of 12 nm were added and mixed using a HENSCHEL MIXER at a circumferential speed of stirring blades of 20 m/s to obtain toner E.

Comparative Example 2

Into the toner base particle A, 1.0% of non-cross-linked monodispersion particle (MP-10000 (a trade name) manufactured by Soken Chemical & Engineering Co., Ltd.) having an average particle diameter of 0.4 μm were added and mixed using a HENSCHEL MIXER at a circumferential speed of stirring blades of 20 m/s, and then, into this mixture, 0.8 parts of isobutyl-treated hydrophobic titanium oxide having an average particle diameter of 15 nm and 1.0 part of hexamethyldisilazane-treated hydrophobic silica having an average particle diameter of 12 nm were added and mixed using a HENSCHEL MIXER at a circumferential speed of stirring blades of 20 m/s to obtain toner F.

Comparative Example 3

A silica sol obtained by a sol-gel method was subjected to an HMDS treatment, and then dried and pulverized to obtain spherical monodispersion silica having a volume average particle diameter D50 of 120 nm. This was called as monodispersion spherical silica A. Into the toner base particle A, 1.0% of this monodispersion spherical silica was added and mixed using a HENSCHEL MIXER at a circumferential speed of stirring blades of 20 m/s, and then, into this mixture, 0.8 parts of isobutyl-treated hydrophobic titanium oxide having an average particle diameter of 15 nm and 1.0 part of hexamethyldisilazane-treated hydrophobic silica having an average particle diameter of 12 nm were added and mixed using a HENSCHEL MIXER at a circumferential speed of stirring blades of 20 m/s to obtain toner G.

[Image Forming Apparatus Used in Examples and Comparative Examples]

The embodiment of the image forming apparatus used in Example and the Comparative Examples will be described.

In the image forming apparatus, in the vicinity of or in contact with a photoconductor drum which is an image bearing member, a charging roller which evenly charges the photoconductor drum, an exposer which is an exposing unit for forming a latent electrostatic image on the photoconductor drum, a developing device which develops the latent electrostatic image to form a visible image (toner image), a transfer belt which transfers the toner image on a transfer paper, a cleaning device which removes a residual toner remaining on the photoconductor drum, a charge eliminating lamp which removes residual electricity on the photoconductor drum, and a photo sensor which controls a voltage applied to the charging roller and a toner concentration during developing are disposed. The toner used in Examples or Comparative Examples is supplied from a toner supplying device to the developing device through a toner supply aperture. Image forming operation is performed as follows. The photoconductor drum is rotated in an anticlockwise direction. On the photoconductor drum, electricity is removed by electricity removing light, and a surface potential is averaged to a standard potential of 0 to −150 V. Subsequently, the surface is charged by the charging roller to make the surface potential around −1000 V. Then, the surface is exposed by the exposer, and the surface potential on the image-formed portion (Image portion) is irradiated with to become 0 to −200 V. The toner on the sleeve adheres to the image portion by the developing device. The photoconductor on which the toner image has been formed is rotated and moved. A transfer paper is sent from a paper feeding section at the moment a tip of the paper is aligned with a tip of the image on the transfer belt, and the toner image on the photoconductor drum is transferred onto the transfer paper by the transfer belt. Subsequently, the transfer paper is sent to the fixing section, and the toner is fusion-bonded by heat and pressure onto the transfer paper. Then the paper is ejected as a copy. The residual toner remaining on the photoconductor drum is scraped off by a cleaning blade in the cleaning device. Subsequently, the residual electricity remaining on the photoconductor drum is removed by the electricity removing light to place the photoconductor drum in the initial state where no toner remains thereon. The image forming apparatus starts the next image formation process.

[Evaluation Items]

Using the above image forming apparatus and the toners and the developers of Examples and Comparative Examples, the following properties were evaluated.

(1) Toner Flowability Retainability

The toner flowability is evaluated as follows using POWDER TESTER PT-S manufactured by Hosokawa Micron Corporation.

The toner immediately after its production is evaluated with calculation using the POWDER TESTER PT-S manufactured by Hosokawa Micron Corporation. The obtained value was represented as X.

Ten grams of the toner immediately after its production and 20 g of an iron powder carrier having a volume average diameter of 50 μm which had not been subjected to a surface treatment were mixed. The mixture was placed in a 50 ml glass vial tube and encapsulated in the glass vial tube. A forced vibration was applied to the glass vial tube at the maximum vibration amplitude using ROCKING MILL manufactured by SEIWAGIKEN Corporation.

After 30 minutes, the mixture was removed from the vial tube and subjected to sieving to separate the toner from the iron powder carrier using a sieve with openings of 25 μm. Then the deteriorated carrier thus obtained was evaluated with calculation using PT-S. The obtained value was represented as Y.

The flowability retainability is calculated from the following equation.

$$\text{Flowability retainability}=(1-|(X-Y)/X|)$$

A value of 80 or more is classified as 'A', a value of 60 or more and less than 80 is classified as 'B', and a value of less than 60 is classified as 'C'.

(2) Cleaning Ability

For evaluating the cleaning ability, in a test room at temperature/humidity of 10° C./15% RH, using an image forming apparatus manufactured by Ricoh Company, Ltd., 5,000 sheets of paper were passed, subsequently the machine was stopped during passing a blank image, a transfer residual toner remaining on the photoconductor passed the cleaning step was transferred onto a blank paper via Scotch tape (manufactured by Sumitomo 3M Ltd.), which was then measured by Macbeth reflection densitometer RD514 type. The cleaning ability was evaluated quantitatively as follows. A toner with a difference between the tape and a blank being less than 0.01 and excellent cleaning ability was classified as 'A'. A toner of which the difference therebetween being 0.01 to 0.02 and the cleaning ability was not excellent but acceptable was classified as 'B'. A toner of which the difference therebetween being more than 0.02 and the cleaning ability was poor was classified as 'C'.

(3) Image Quality

For the image quality, image quality degradation (specifically, occurrence of transfer fault and image scumming) of the image after passing paper sheets was comprehensively evaluated. Using an image forming apparatus manufactured by Ricoh Company, Ltd., 5,000 sheets were passed, subsequently a black solid image was passed, and for the resulting image, transfer fault level was visually evaluated and ranked.

For the image scumming, using an image forming apparatus manufactured by Ricoh Company, Ltd., 5,000 sheets were passed, subsequently the machine was stopped during developing a blank paper image, the developer on the photoconductor after the developing was transferred onto a tape, and the difference in the image density between the tape and a developer-untransferred tape was measured by a spectrodensitometer (manufactured by X-Rite), and evaluated quantitatively. A toner with the difference therebetween being less than 0.30 was classified as 'A', and a toner with the difference being 0.30 or more was classified as 'C'.

Comprehensively evaluating the transfer fault and the image scumming occurrence, a toner exhibiting excellent image quality was classified as 'A', a toner of which the image quality was not excellent but acceptable was classified as 'B', and a toner of which the image quality was poor was classified as 'C'.

(4) Photoconductor Flaws

Occurrence of photoconductor flaws was evaluated in an image forming apparatus manufactured by Ricoh Company, Ltd., through which 100,000 sheets of a 4% image density of A4 size image were printed. A toner with which the photoconductor had no flaw or a minute flaw and was in a very good condition was classified as 'A', a toner with which the photoconductor had a few flaws, which was however not reflected in a printed image, and thus was acceptable was classified as 'B', and a toner with which the photoconductor had a few flaws, which was reflected in printed images or with irretrievable flaws was classified as 'C'.

The evaluation results are shown in Table 1.

TABLE 1

| | Toner flowability retain-ability | Filming of photoconductor | Cleanig ability | Image quality | Photo-conductor flaw |
|---|---|---|---|---|---|
| Example 1 | B | A | A | A | A |
| Example 2 | A | A | A | A | A |
| Example 3 | B | A | A | A | A |
| Example 4 | A | A | A | A | A |
| Comparative Example 1 | C | A | A | A | A |
| Comparative Example 2 | C | A | A | A | A |
| Comparative Example 3 | B | C | B | A | C |

By mixing an organic silicone fine particle satisfying specific conditions in a toner, it becomes possible to maintain excellent cleaning ability and image quality in electrophotographic processes, and to effectively prevent an occurrence of flaws on a photoconductor surface.

What is claimed is:

1. A toner, comprising:

a colored particle, and an external additive, and wherein the colored particle comprises a binder resin, a colorant, and a releasing agent; and the external additive is a cross-linked polysiloxane fine particle having hemispherical shape and a volume average particle diameter of 0.05 μm to 6.0 μm.

2. The toner according to claim 1, further comprising one or more other external additives.

3. The toner according to claim 1, further comprising one or more other external additives having a B.E.T. specific surface area in the range of 20 $m^2/g$ to 300 $m^2/g$.

4. The toner according to claim 1, further comprising one or more other external additives selected from the group consisting of silica, a titanium compound, alumina, a cerium oxide, a calcium carbonate, a magnesium carbonate, a calcium phosphate, fluorine-containing resin fine particles, silica-containing resin fine particles, and nitrogen-containing resin fine particles.

5. The toner according to claim 1, further comprising a titanium compound as a further external additive, wherein the titanium compound is obtained by reacting a part of or all of $TiO(OH)_2$ produced by a wet system with any one of a silane compound and a silicone oil.

6. The toner according to claim 1, further comprising a titanium compound as a further external additive, wherein the titanium compound has a specific gravity of 2.8 to 3.6.

7. The toner according to claim 1, wherein the colored particle is obtained by a method comprising dissolving or dispersing in an organic solvent a toner composition comprising a toner binder resin comprised of a compound having an active hydrogen group and a modified polyester resin capable of reacting with an active hydrogen group to form a solution or dispersion, dispersing into droplets the solution or dispersion in an aqueous medium comprising a resin fine particle, reacting the compound having an active hydrogen group with the modified polyester resin capable of reacting with an active hydrogen group, and removing the solvent from the dispersion fluid thus obtained.

8. The toner according to claim 1, wherein the colored particle is obtained by a melt-kneading/pulverization method.

9. A developer, comprising:

the toner according to claim 7, and a carrier.

10. An image forming method, comprising:

developing a latent electrostatic image formed on a latent image bearing member with a toner according to claim 1 to form a toner image, and transferring the toner image onto a transfer material to form a transferred image.

11. An image forming method, comprising:

developing a latent electrostatic image formed on a latent image bearing member with a with a developer comprising the toner according to claim 1 and a carrier, to form a toner image, and transferring the toner image onto a transfer material to form a transferred image.

12. A process cartridge, comprising:

a photoconductor, and a developing unit, the photoconductor and the developing unit being integrated as a unit, the process cartridge may further comprise one image processing unit selected from the group consisting of a charging unit, a transfer unit, a cleaning unit, and a charge eliminating unit, wherein the developing unit holds the toner according to claim 1.

* * * * *